US005295429A

United States Patent [19]

Monk

[11] Patent Number: 5,295,429

[45] Date of Patent: Mar. 22, 1994

[54] PRESSURIZED FLUID DIRECTIONAL FLOW CONTROL VALVE ASSEMBLY

[75] Inventor: Robert J. Monk, Cedar Hill, Tex.

[73] Assignee: Joe Harris Monk, Midlothian, Tex.

[21] Appl. No.: 941,748

[22] Filed: Sep. 8, 1992

Related U.S. Application Data

[63] Continuation-in-part of Ser. No. 651,150, Feb. 6, 1991, abandoned.

[51] Int. Cl.[5] ..... F15B 13/04

[52] U.S. Cl. ..... 91/445; 91/459; 137/635

[58] Field of Search ..... 91/275, 362, 444, 445, 91/459; 137/596.17, 596.2, 635

[56] References Cited

U.S. PATENT DOCUMENTS

| | | | |
|---|---|---|---|
| 1,379,025 | 5/1921 | Jones et al. | 137/635 |
| 2,207,599 | 7/1940 | Schoettinger et al. | 137/635 |
| 3,131,573 | 5/1964 | Bent . | |
| 3,339,461 | 9/1967 | Sommerer | 137/596.2 |
| 4,747,424 | 5/1988 | Chapman | 137/596.2 |

FOREIGN PATENT DOCUMENTS 1242130 8/1960 France .

*Primary Examiner*—Edward K. Look
*Assistant Examiner*—F. Daniel Lopez
*Attorney, Agent, or Firm*—Timmons & Kelly

[57] ABSTRACT

A valve assembly is disclosed in two embodiments for selectively controlling pressurized fluid flow to operate a fluid operated working cylinder and piston. The valve assembly includes a valve body, groups of three bores operably paired in the body, biased plunger valves interposed in each of the bores, and a separate passage inter-connecting between each bore group on one side of the interposed valves. There is provided a pressure connection to a first one of the bores in each group on the other side of the interposed valves away from the passage and a first side cylinder connection to a second one of said bores in one of each pair of groups. The other cylinder connection is provided to a second one of the other one of each pair of groups of three bores while an exhaust connection is provided to a third one of the bores in each group. A control is operable for selectably actuating the interposed valves for proper inter-connection between the passage, valves and corresponding connection to provide either contraction, extension or a neutral condition for the working piston and cylinder.

22 Claims, 24 Drawing Sheets

| | NO LINEAR ACTION (NEUTRAL) | NEUTRAL & LINEAR ACTION | CW & LINEAR ACTION | CCW & LINEAR ACTION |
|---|---|---|---|---|
| P1 | C | C | C | O |
| C1 | O | O | O | O |
| E1 | C | O | O | C |
| P2 | C | C | O | C |
| C2 | O | O | O | O |
| E2 | C | O | C | O |

| | NO LINEAR ACTION (NEUTRAL) | NEUTRAL & LINEAR ACTION | CW & LINEAR ACTION | CCW & LINEAR ACTION |
|---|---|---|---|---|
| P1 | O | O | C | O |
| C1 | C | O | O | O |
| E1 | O | O | O | C |
| P2 | O | O | O | C |
| C2 | C | O | O | O |
| E2 | O | O | C | O |

| | NO LINEAR ACTION (NEUTRAL) | NEUTRAL & LINEAR ACTION | CW & LINEAR ACTION | CCW & LINEAR ACTION |
|---|---|---|---|---|
| P1 | O | C | C | O |
| C1 | C | C | O | O |
| E1 | O | O | O | C |
| P2 | O | C | O | C |
| C2 | C | C | O | O |
| E2 | O | O | C | O |

| | NO LINEAR ACTION (NEUTRAL) | NEUTRAL & LINEAR ACTION | CW & LINEAR ACTION | CCW & LINEAR ACTION |
|---|---|---|---|---|
| P1 | O | C | C | O |
| C1 | C | O | O | O |
| E1 | O | O | O | C |
| P2 | O | C | O | C |
| C2 | C | O | O | O |
| E2 | O | O | C | O |

| | NO LINEAR ACTION (NEUTRAL) | NEUTRAL & LINEAR ACTION | CW & LINEAR ACTION | CCW & LINEAR ACTION |
|---|---|---|---|---|
| P1 | O | C | O | C |
| C1 | O | C | O | O |
| E1 | O | O | C | O |
| P2 | O | C | C | O |
| C2 | O | C | O | O |
| E2 | O | O | O | C |

| | NO LINEAR ACTION (NEUTRAL) | NEUTRAL & LINEAR ACTION | CW & LINEAR ACTION | CCW & LINEAR ACTION |
|---|---|---|---|---|
| P1 | O | O | O | C |
| C1 | O | C | O | O |
| E1 | O | O | C | O |
| P2 | O | O | C | O |
| C2 | O | C | O | O |
| E2 | O | O | O | C |

| | NO LINEAR ACTION (NEUTRAL) | NEUTRAL & LINEAR ACTION | CW & LINEAR ACTION | CCW & LINEAR ACTION |
|---|---|---|---|---|
| P1 | O | C | O | C |
| C1 | O | O | O | O |
| E1 | O | O | C | O |
| P2 | O | C | C | O |
| C2 | O | O | O | O |
| E2 | O | O | O | C |

O = OPEN
C = CLOSED

| | NO LINEAR ACTION | NEUTRAL & LINEAR ACTION | CW & LINEAR ACTION | CCW & LINEAR ACTION |
|---|---|---|---|---|
| P1 | C | C | C | O |
| C1 | O | O | O | O |
| E1 | C | O | O | C |
| P2 | C | C | O | C |
| C2 | O | O | O | O |
| E2 | C | O | C | O |
| P3 | C | O | C | O |
| C3 | O | C | O | O |
| E3 | C | O | O | C |
| P4 | C | O | O | C |
| C4 | O | C | O | O |
| E4 | C | O | C | O |

| | P1 | C1 | E1 | P2 | C2 | E2 | P3 | C3 | E3 | P4 | C4 | E4 | P5 | C5 | E5 | P6 | C6 | E6 |
|---|---|---|---|---|---|---|---|---|---|---|---|---|---|---|---|---|---|---|
| CCW & LINEAR ACTION | C | O | O | C | C | O | C | O | C | C | O | O | C | O | C | C | O | O |
| CW & LINEAR ACTION | C | C | O | O | C | C | O | C | O | O | C | C | O | O | O | O | O | C |
| NEUTRAL & LINEAR ACTION | C | O | C | O | C | O | C | O | C | O | C | O | C | O | O | C | O | C |
| NO LINEAR ACTION | C | O | C | C | O | C | C | O | O | C | O | C | O | O | C | C | O | O |

PRESSURIZED FLUID DIRECTIONAL FLOW CONTROL VALVE ASSEMBLY

This application is a continuation-in-part of application Ser. No. 07/651,150 filed Feb. 6, 1991, now abandoned.

FIELD OF THE INVENTION

This invention relates generally to fluid flow control valve assembly and more specifically to an assembly of multiple valves and actuation thereof for controlling the flow of pressurized fluid to working means such as hydraulic or pneumatic cylinders having pressure activated pistons therein. More specifically the invention relates to an assembly of valves for controlling cylinder and piston arrangements in which actuation is achieved in both directions by pressurizing above and alternatingly below the piston.

BACKGROUND OF THE INVENTION

In the past, pressurized fluid supplied to working means such as hydraulic and pneumatic cylinders has generally been controlled by special complex valves known as "spool valves". Such spool valves incorporate a linear shifting spool which alternately connect selected multiple fluid flow passages together. Such spool valves incorporate a linearly shifting spool fitted inside a cylinder. The spool has multiple flow grooves cut in its surface at various locations and the cylinder has internal cylindrical grooves under cut within its surface separated by sealing O-rings such that linear motion of the spool aligns the flow grooves for passage of fluid from one of the cylindrical under cut grooves to another one of the cylindrical under cut grooves. Selection of which under cut grooves are to be inter-connected is determined by moving the spool linearly from one position to another.

The spool valves require special machining inside the bore to create the multiple under cut grooves into which the seals are inserted and those inter-connected with the various fluid flow passages. This special internal machining of the cylinders requires high initial cost. Not only is the process time consuming; but, there is a high degree of material rejection due to metal porosity. Leaks around the type of required deep groove cuts are not acceptable for proper spool valve operation. Also spool valves present high cost to the user because maintenance is complicated when the internal seals require replacement. Seal wear is accelerated because of the nature of a spool having grooves in its external surface sliding back and forth over the seals and also because the pressurized fluid is in direct contact with the rubberized or flexible seals as it flows past from one selected passage way to a second selected passage way to be inter-connected.

The fluid flow characteristics of the spool valve is often adversely affected by its high internal restriction of fluid flow. The convoluted flow path of the fluid through the spool valve can slow reaction time and reduce the net effective pressure or power to the working cylinders.

Heretofore pressurized fluid flow control with individual valves have been used primarily to interrupt single direction fluid flow streams or have been utilized to select between two pressurized fluids sources joined with a single fluid outlet. These prior valve assemblies such as of the poppet type have generally had poppets which are directly actuated by rotary cam plates or lever arms. For example, U.S. Pat. No. 2,441,253 describes a valve assembly having a number of radially oriented poppet valves selectively actuated by contact with the exterior surface of a rotary cam. The poppet valves are arranged perpendicular to the axis of rotation of the cam and is designed for inter-connecting one of the several radially oriented passage ways with a single axial passage way. Because of the direct actuation of the poppet valves, considerable external force must be applied to rotate the cams.

Other poppet valves are described in U.S. Pat. No. 2,580,731 and in U.S. Pat. No. 3,756,284; both of which show a toggle lever actuated valve arrangement such that the user chooses between opening one of two poppet valves depending on the direction the toggle lever is moved. Again, as direct actuation is required considerable external force must be applied to move the lever arms. Moreover, neither of these prior patents show or suggest a valve assembly adaptable for controlling fluid pressure to a pressure actuated working means such as a push and pull hydraulic piston and cylinder device where pressurized fluid must simultaneously flow to and from the working means.

Another valve assembly is disclosed in U.S. Pat. No. 2,609,207 which employs a handle that is rotated to a plurality of index positions and then pivoted for depression against a spring force to actuate a selected valved arrangement. This valve assembly is adapted to be connected between a source of fluid pressure and one or a plurality of fluid pressure actuated motors such as double acting or reversible oscillating or reciprocating piston or cylinder devices. The valve mechanism disclosed uses a complex arrangement of sliding valves and pressure actuated slide and ball check valves by which fluid continuously flows through the valve assembly from the source pressure to the exhaust until the lever is depressed in one position which simultaneously pressurizes one side of the cylinder and exhausts the other side of the cylinder. When the valve lever is lifted both the pressure to the cylinder and the exhaust to the cylinder are closed off such that the cylinder and piston retains its existing position. The raised handle returns the valve again to its neutral condition in which fluid circulates in tandem from the pressure source to the exhaust source. Moving the handle to its second index position and depressing it there actuates the cylinder and piston to pressurize and exhaust the opposite side so the piston removes in the opposite direction from the first index position. The '207 patent does not disclose a means for obtaining other operational neutral conditions such as completely closed, completely open, or floating cylinder and piston condition, but only discloses the tandem neutral arrangement.

Another poppet valve arrangement for automatic dispensing of soda water is disclosed in U.S. Pat. No. 868,322 which shows an arrangement of parallel reciprocation of four spring actuated valves axially aligned around the axis of a rotary actuation cam. The stems of the valves are adapted to be engaged by sliding inclined cam projections on the face of a rotary operating disc or plate. The springs serve to close those valves when the valve stems are not engaged by the cam projections. In the four valve arrangement disclosed, the projections are at diametrically opposed positions on the face of the rotary plate such that two opposed valves are opened simultaneously while the other two valves are simultaneously closed. The use of sliding inclined cams requires substantial rotational force when working with high pressure cylinder and piston machinery, as opposed to soda dispensing as in the '322 patent. Further there is no disclosure or suggestion in the '322 patent of a means by which the cylinder and piston arrangement can simultaneously receive pressurized fluid and discharge exhaust fluid. In particular, there is no suggestion of means for converting such a device to one which controls simultaneous flow of pressurized fluid to and from the working means and also one which is adaptable to provide any one of various operational neutral conditions including closed, open, float and tandem.

Generally the prior valves do not allow a construction which requires only outside metal turning, straight internal boring, outside milling, drilling and tapping. The prior devices do not provide for a control valve assembly which is economical, efficient and easily maintainable while providing complete control of pressurized fluid to and from a working cylinder and piston arrangement and which has easily changeable operating cams for selecting any one of four operational neutral conditions from among closed, open, float or tandem as may be required by a particular working environment.

SUMMARY OF THE INVENTION

The structure of the present inventive valve assembly provides pressurized fluid directional flow control which simultaneously controls pressurized fluid to and from working means such as hydraulic or pneumatic cylinder and piston devices and also provides means for easily selecting desired neutral conditions such as closed, open, float or tandem.

The poppet valve assembly selectively provides pressurized fluid to one side of a fluid operated piston within a cylinder while exhausting fluid from the other side of the piston such that the piston moves in one of two directions. In a second operating position, the valve assembly provides pressurized fluid to the previously exhausted side of the piston while exhausting the previously pressurized side of the piston thereby providing movement of the piston in the opposite direction. Any one of four operational neutral conditions (also any other user defined condition) can be pre-selected merely by replacing in the same valve assembly a preselected one of four rotary actuating plate layout designs with another one of four plate designs. Other user determined conditions can also be pre-selected with appropriate actuating plate layouts. The four pre-selectable neutral conditions include a closed condition in which there is no fluid movement through the valve, an open condition (in which all fluid passage ways are open to and from the pressure source, the cylinder, and the exhaust), a float condition (in which both sides of the cylinder are interconnected with the exhaust such that the piston can move freely in either direction), and a tandem condition (in which fluid flows from the pressure source to the exhaust while both sides of the cylinder remain closed such that no movement of the piston within the cylinder occurs).

The inventive valve assembly in accordance with a first embodiment comprises a body having first and second ends and a central axis extending therebetween. An even number of groups of three bores are defined by the body substantially parallel to the central axis, with each bore substantially equidistance radially outward from the central axis and substantially equidistance from each other bore radially around the central axis. Interposed within each bore is a poppet valve assembly which is biased in a closed direction. Passage means are provided laterally in the body adjacent to the second end of the body to interconnect each group of three bores. One of the bores in each group is connected at the opposite end from the passage inter-connection to a pressure source, one of the bores of each group of three is connected at the end thereof opposite of the passage connection to a cylinder, and one of each group of three bores is connected away from the passage inter-connection to an exhaust such as an exhaust fluid reservoir. The poppet valves are actuated at one end thereof using a rotationally positionable plate having voids therein at various radial locations such that linear motion of the plate contacts selected opposed pairs of poppet valves while not contacting other opposed pairs of poppet valves. The even groups of three valves are arranged in "mirror-image" fashion across a line drawn diametrically through the center of the valve body, in the case of two sets of three valves. In the case of four groups of three valves, the valve arrangement forms a "mirror-image" between each group of three in one-half of the circle across the radial line dividing the half of the circle into quadrants. This unique geometry allows the plate to contact the poppet valve actuation stems with equal force on both sides of the actuation plate such that the tendency to tip the plate is minimized thereby reducing the wear on the mechanism.

The rotational position of the valve actuation plate is achieved while no contact is made with the poppet valves and then simply linear actuation is involved when the valves are to be opened. The control mechanism for this can be of a unique multiple sliding cylinder rotary to linear actuator arrangement according to the invention or may by achieved using electrical stepper motors or electrical rotary solenoids. Electronic or hydraulic pre-programmed circuitry employing position sensing switches or pressure sensors is used to insure that rotation of the actuation plate occurs only when there is no linear actuation such that no rotation of the plate occurs while in contact with the poppet valve stems or with rocker arms.

In accordance with a second embodiment of the invention there is disclosed a closed or open biased plunger (poppet) valves constructed for simplified removal for seal replacement when necessary. Utilizing the normally closed and normally open valves together allows selective neutral conditions without actuating the valves as to render operation more efficient.

A bidirectionally operable linearally displaceable actuator indexes a pre-programmed plate toward the individual valves for their direct actuation without the use of fulcrums or rocker arms. By being rotationally clear of the valves, the pre-programmed plates incur minimum resistance to rotation when operably rotated in stepped segments by a spring biased rotary actuator. By means of the actuator, the pre-programmed plate is indexed from its clockwise or counter clockwise position to its neutral position on its loss of power or on a controlled command. This feature enables at least selective instant closed or open or tandem neutral conditions to exist on start up while greatly simplifying the valve control since all movable components of the valve can be set at their biased or neutral positions.

The pre-programmed plates of this embodiment can be used in combination with normally open or normally open and normally closed biased plunger valves to provide at least a closed neutral condition without linear actuation. Open, tandem or float conditions are effected with linear actuation along with either contraction or extension for a working piston and cylinder.

Alternatively, the valve combination can provide at least an open neutral condition without linear actuation and closed or tandem or float conditions with linear actuation along with either contraction or extension for a working piston and cylinder. Or they can provide at least a tandem neutral condition without linear actuation and open or closed or float conditions with linear actuation. Either contraction or extension for a working piston and cylinder can occur concomitantly by means of the pre-programmed plates hereof since the number of biased plunger valves requiring actuation for a corresponding decrease in actuation time is reduced.

BRIEF DESCRIPTION OF THE DRAWINGS

These and other objects of the invention will be more fully understood with reference to the drawings in which like numbers represent like elements and in which.

DETAILED DESCRIPTION OF THE DRAWINGS

Figure 1:
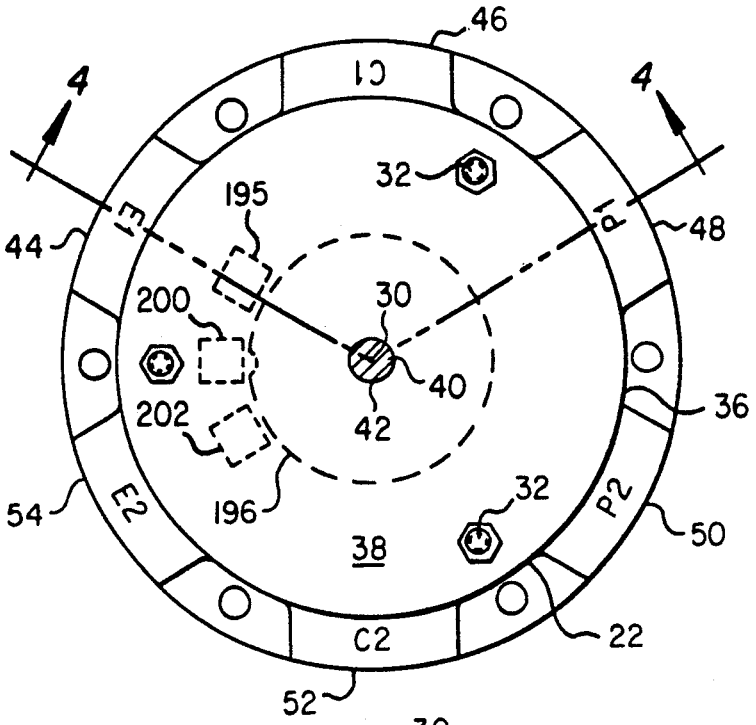
FIG. 1 is a top plan view of the valve assembly in accordance with a first embodiment of the invention.
Figure 2:
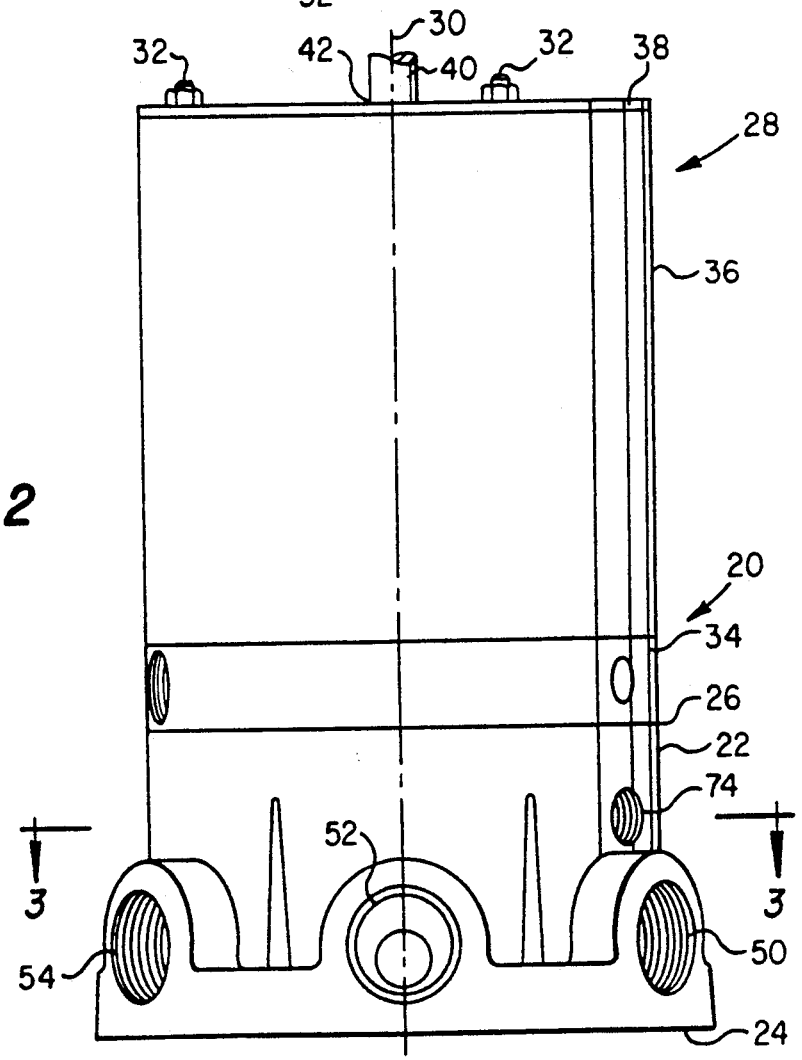
FIG. 2 is a side plan view of the valve assembly of FIG. 1.

Referring to FIG. 1 which is a top plan view of the exterior of the valve assembly in accordance with a first embodiment of the invention and also referring to FIG. 2 which is a side plan view of the exterior thereof, the basic configuration and construction of valve assembly 20 can be seen. Valve assembly 20 has a body 22 having a first end 24 sometimes referred to as the connection end 24 at which conduits (not shown) conveying fluid to be controlled will be connected to the valve assembly. There is a second end 26, sometimes referred to as actuation end 26, which will inter-connect with actuation assembly 28. The entire valve assembly 20 including valve body 22 is formed in a generally cylindrical construction along and about central axis 30. The actuation assembly 28 and the body 22 are inter-connected with connector means 32, which may be elongated bolts and nut fasteners 32, arranged in a symmetrical pattern concentrically about axis 30 to provide even inter-connecting pressure while allowing easy disassembly for repair or for selecting the neutral condition as will be discussed below.

The exterior of the actuation assembly comprises an interposed member 34, a cylindrical dust cover 36, and circular top dust cover 38. For this embodiment there is shown an actuator shaft 40 which is in axial alignment with central axial 30 that may project through an orifice 42 in top dust cover 38.

Valve body 22 is provided with fluid connection openings 44, 46, 48, 50, 52, and 54. For this embodiment each of the fluid connection openings is provided with means for making fluid tight connections to conduits such as pipe threads or other available means for fluid tight connections. Also as will be more fully understood with reference FIG. 4, each of the fluid connection openings may alternatively be parallel to central axis 30 as with openings 45, 47, and 49 of FIG. 4 or for the convenience of the user both side openings 44, 46, 48, etc., and corresponding end openings 45, 47, and 49 may both be provided. It being understood that where both corresponding openings are provided one or the other may be easily plugged as for example by using standard threaded pipe plugs.

Figure 3:
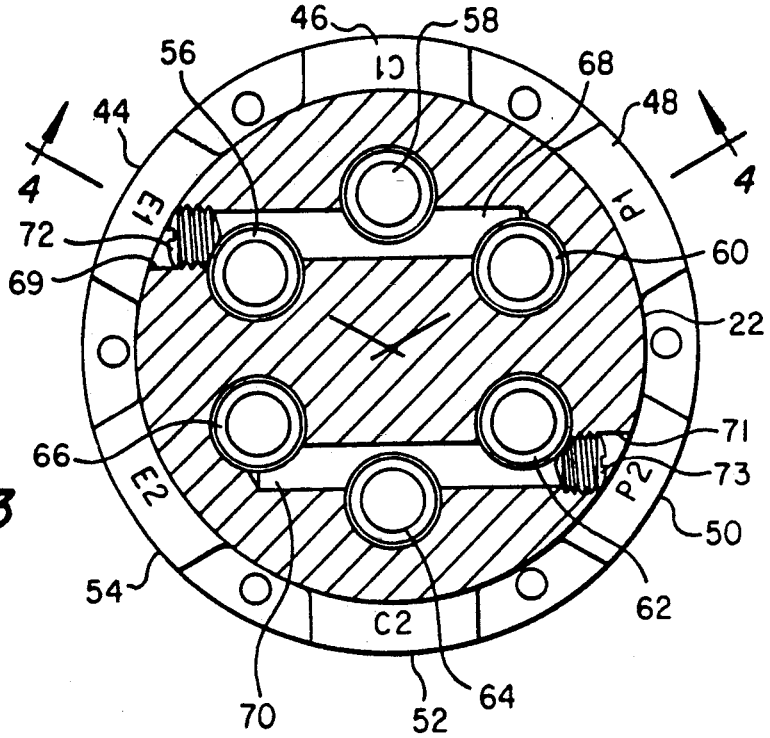
FIG. 3 is a cross sectional view taken along section line 3—3 of FIG. 2.
Figure 4:
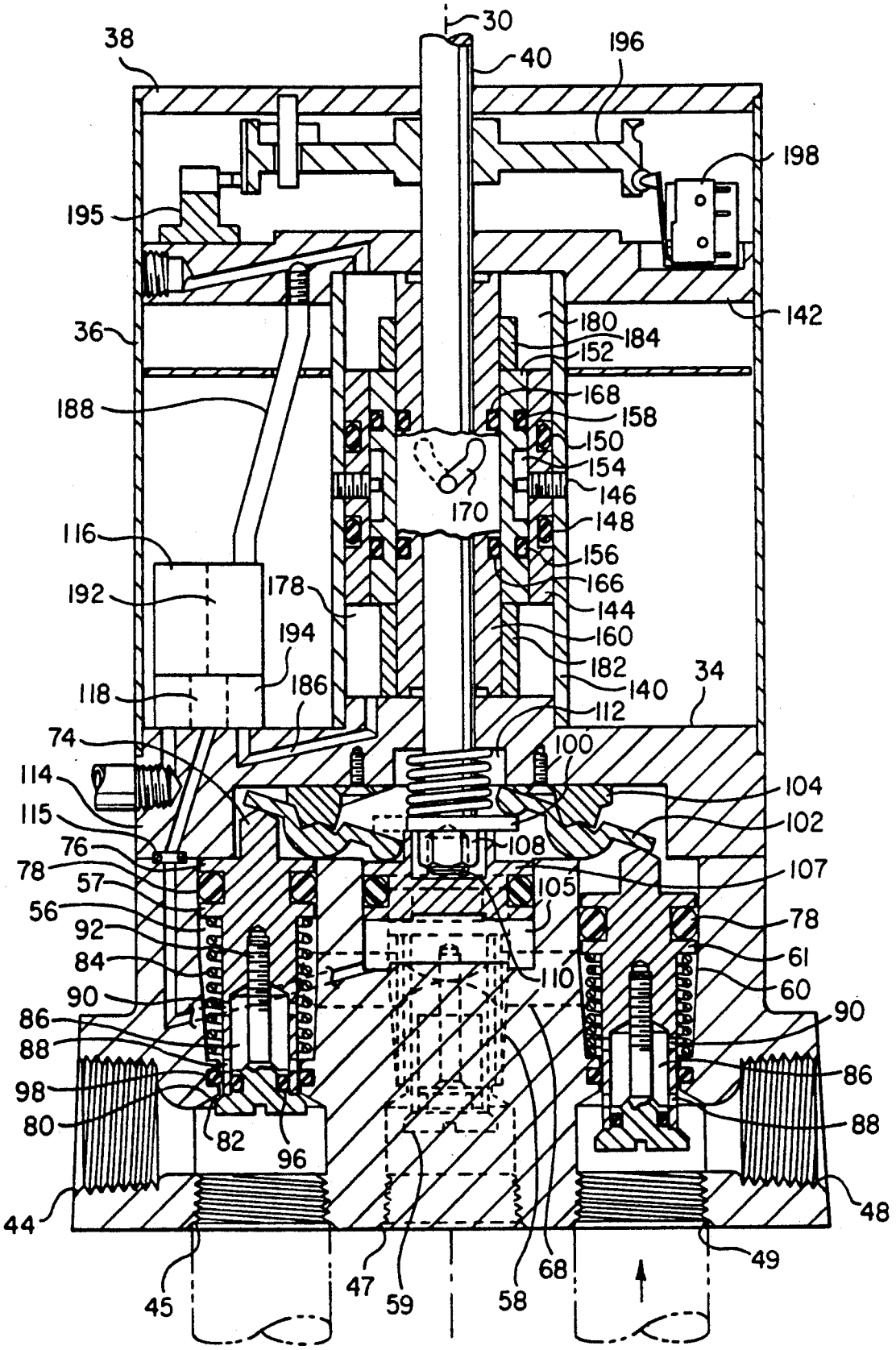
FIG. 4 is a partial cross sectional view taken along section line 4—4 of FIG. 3.

With reference to FIG. 3 and FIG. 4 it can be further understood that each of the fluid connection openings 44, 46, 48, 50, 52, and 54, or pairs of openings 44 and 45, 46 and 47, 48 and 49 as shown in FIG. 4 corresponds to a vertical bore 56, 58, 60, 62, 64 or 66.

With reference to FIG. 3 which is a cross-sectional view along section line 3—3 of FIG. 2 it can be seen that each of the fluid connection openings 44 (and/or 45), 46 (and/or 47), 48 (and/or 49), 50, 52, and 54 correspond to bores 56, 58, 60, 62, 64, and 66, respectively. Further with reference to FIG. 4, which is a cross-sectional view taken along section line 4—4 of FIG. 1, (also section line 4—4 of FIG. 3) it can be seen that each of the fluid connection openings is in fluid communication through body 22 with one corresponding bore.

In the embodiment hereof there are even numbers of groups of three bores spaced equidistance from central axis 30 and equidistance from each other bore radially around body 22. Each group of three bores cooperate with poppet valves and corresponding three fluid connections to control fluid to and from one side of a piston in a cylinder. Thus, opening 46 (and/or 47) and corresponding bore 58 interconnect with side 1 of a cylinder (schematically designated C1) and fluid connection 44 (and/or 45) is inter-connected with bore 56 for exhausting fluid (schematically designated E1) from that first side of a cylinder while fluid opening 48 (and/or 49) is inter-connected with bore 60 for controlling pressurized fluid (schematically designated P1) to the first side of a cylinder. In a mirror image arrangement across an imaginary diameter, fluid connection 52 and bore 64 are inter-connected with the opposite side 2 of a working cylinder (C2) and connection opening 54 and bore 66 are inter-connected and used for exhausting cylinder side 2 (E2) and connection 50 and corresponding interconnected bore 62 are used for pressurizing (P2) the second side 2 of a cylinder all of which will be more fully explained in connection with the poppet valve actuation.

Again referring to FIG. 3, inter-connecting each group of three bores 56, 58 and 60 and 62, 64, and 66 are passages 68 and 70, respectively. It will be noted for ease of manufacture that the bores are made with simple drilling machining process by merely indexing the body about its central axis 30 at sixty degree (60°) radial intervals. The passages 68 and 70 are also constructed with a simple drilling operation through the side of body 22 forming openings 69 and 71 which can be conveniently closed off as by plugging them with leak proof threaded plugs 72 and 73.

With reference to FIG. 4 the further construction of the inventive valve assembly 20 will be further described in connection with bores 56, 58, and 60, which bores correspond to a single group of three bores which control a single side 1 of a cylinder. It will be understood that the description in connection with this group of three bores and poppet valves is typical of other groups of three bores and poppet valves except with respect to the pre-programmed control of each group of three poppet valves with use of actuation plates as will be described more fully with respect to FIGS. 7 through 14 below. In this regard bore 56 has interposed within it a poppet valve 57, bore 58 has interposed within it a poppet valve 59 (shown in hidden lines in FIG. 4) and bore 60 has a poppet valve 61 interposed therein. Likewise, other substantially identical poppet valves will be interposed in all the bores of the valve assembly.

Each poppet valve is of similar construction which can be understood with reference to poppet valve 57 in FIG. 4. Poppet valve 57 is constructed for sealed sliding motion within bore 56. It has a projection 74, or valve stem 74, by which the poppet valve is actuated. There is a seal groove 76 with first sliding seal 78 interposed therein for a sealed sliding engagement with the interior surface of bore 56. At the fluid connection end of bore 56 there is a restriction orifice 80 which is a portion of bore 56 having a smaller diameter than the remainder of bore 56. Poppet valve 57 is provided with a valve seat 82 which is biased, as for example with a spring 84, against restriction orifice 80 such that the poppet 57 when not actuated is urged toward its closed relation.

To further facilitate fluid tight closure, the poppet valve 57 is advantageously constructed with a hollow chamber 86 with spaced apart lower ports 88 and upper ports 90. Ports 88 and 90 can be made, for example, by drilling radially around the circumference of poppet valve 57. The hollow chamber 86 can, for example, be conveniently constructed by axial drilling partially into the cylindrical shaped poppet 57 and by drilling and threading a portion of the poppet valve to an additional depth at the apex of the chamber 86. The valve seat 82 is formed by closing off hollow chamber 86 at the exterior end thereof as by fastening a wide headed screw 92 into the threaded portion. A static seal 96 ensures a fluid tight chamber 86. There is another sliding seal at 98 interposed in bore 58 adjacent to restriction orifice 80 such that when the poppet valve is closed, as shown for poppet valve 57 in FIG. 4, the seal 98 prevents any fluid from entering into bore 56 from connection 44 or 45. When the poppet is actuated (as shown for poppet 61 in bore 60 on the right hand side of FIG. 4) fluid from the fluid connections 48 or 49 can enter chamber 86 through lower ports 88 and can exit from chamber 86 through upper ports 90 into passage 68. In this manner, when any poppet valve is open the fluid connection is inter-connected through the bore with the cross passage 68 which is shown in hidden lines in FIG. 4.

The poppet valves are actuated using a pre-programmed plate 100 which either directly contacts projection 74 of the poppets or actuates the poppets through rocker arms 102 correspondingly positioned adjacent to each bore and poppet for pivoting as for example about pivot fulcrum 104 secured to actuator interposed member 34. The actuator plate 100 may be linearly moved along axis 30 with the use of a cylinder 105 and a sealed piston 107 formed coaxially with center line 30 and with actuator shaft 40. Actuator plate 100 is removably secured to actuator shaft 40 using splines or a key 106 which also serves to locate the rotary position of plate 100 as will be discussed below. A threaded end 110 of shaft 40 and a removable nut 108 secures plate 100 to shaft 40. A biasing means 112, such as a compression spring 112, acts against interposed member 34 and plate 100 to move the plate 100 and piston 107 down into cylinder 105 when pressure is sufficiently reduced in cylinder 105. The pressure is supplied through a passage 114 which is inter-connected with pilot fluid control means 116 which includes a portion 118 for controlling pilot fluid for linear movement of plate 100. Passage 114 is designed for cross-drilling construction. Where passage 114 inter-connects between interposed member 34 and the second en 26 of valve body 22, a passage sealing means 115 such as a groove and O-ring can be employed.

Figure 7:
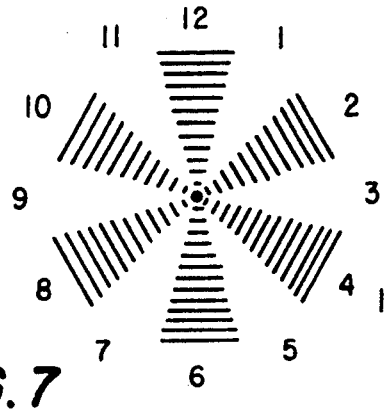
FIG. 7 is a schematic representation of the operable sectors of the various alternative pre-programmed actuation plates which are schematically depicted in FIGS. 8–14.
Figure 8:
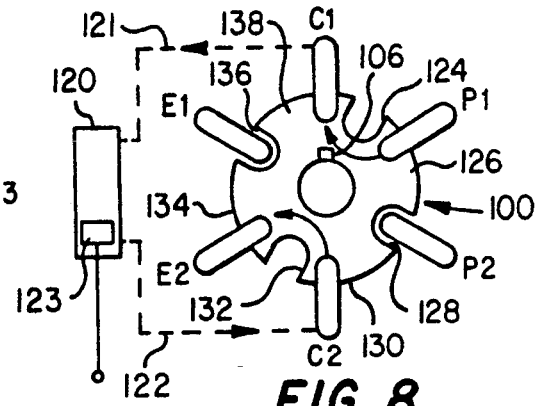
FIG. 8 is a schematic view of one alternative actuation plate pre-programmed for a closed neutral achievable without linear actuation and further schematically showing operational extension of a piston from working cylinder when the plate is linearly actuated.
Figure 9:
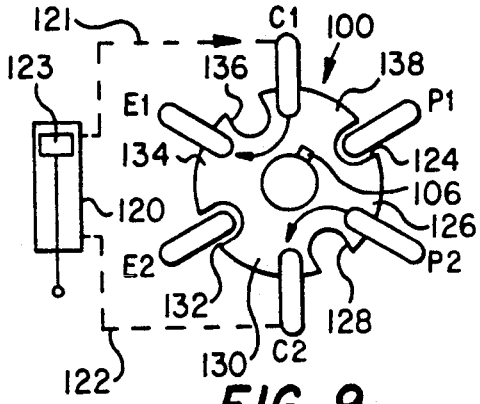
FIG. 9 is schematic representation of the pre-programmed plate of FIG. 8 shown in a clockwise rotary position and depicting the retraction of a piston into a working cylinder.

Referring now to FIGS. 7, 8, and 9, the unique and advantageous construction of plate 100 can be more fully understood. FIG. 7 is a schematic representation of twelve potentially available radial working positions corresponding to thirty degree (30°) sectors numbers 1–12. It is noted in this regard that for purposes of explanation each poppet and bore of the depicted six-poppet valve assembly is located within an even numbered one of the twelve sectors. In the case of a twelve poppet valve assembly (not shown), a bore would be located at each of the numbered twelve sectors such that the angular displacement between each bore would be 30° rather than 60° as with a six bore or six poppet valve assembly.

Referring to FIG. 8 which is a schematic top view of the plate 100 in which rocker arms for controlling the poppets in the various bores corresponding to the poppet connected to the first side C1 of a cylinder 120 and piston 123, the poppet E1 for exhausting the first side of the cylinder 120 and the poppet P1 for pressurizing the first side C1 of cylinder 120. Diametrically opposed to the first group of the three poppet controls for controlling side 1 of the cylinder 120 is a group of three poppet controls for side 2 of cylinder 120. Poppet control C2 connects with side 2 of cylinder 120. Exhaust poppet control E2 is for exhausting the second side of the cylinder and the poppet control P2 is for pressurizing the second side of the cylinder 120. Thus, corresponding to the sectors of FIG. 7, C1 is located at position 12, P1 is located at position 2, P2 is located at position 4, C2 is located at position 6, E2 is located at position 8 and E1 is located at position 10. For purposes of explanation key 106 is shown in FIG. 8 initially corresponding to the C1 or the 12 position. Working cylinder 120 is shown schematically inter-connected through schematically depicted conduits 121 (shown in phantom lines) with fluid connection opening 46 (or 47), bore 58 and poppet valve 59 all of which are schematically designated C1 in FIG. 8. Working cylinder 120 is connected through schematically depicted conduit 122 at its opposite end across piston 123 to fluid connection opening 52 and corresponding bore 64 with poppet valve therein all of which are schematically designated C2 in FIGS. 8-14.

Plate 100 is pre-programmed for a closed neutral condition without linear action, for pressurizing the first side of cylinder 120 with linear action, and (as shown in FIG. 9) it is pre-programmed for actuation of the second side of cylinder 120 when plate 100 is rotated 30° clockwise when viewed from the top. Referring to FIGS. 8 and 9 the pre-programming of plate 100 is accomplished using alternating cut out areas 124, solid plate surface 126, cut out portion 128, solid surface 130, cut out portion 132, solid surface 134, cut out portion 136, and solid portion 138. Thus, for the specific preprogrammed action for a closed neutral without linear action, there are four cut out portions evenly spaced at 90° from one another around the periphery of plate 100 and plate 100 is in its neutral condition, i.e., with key 106 at the twelve o'clock position. The first cut out portion 124 is 30° clockwise from the key 106.

Figure 6:
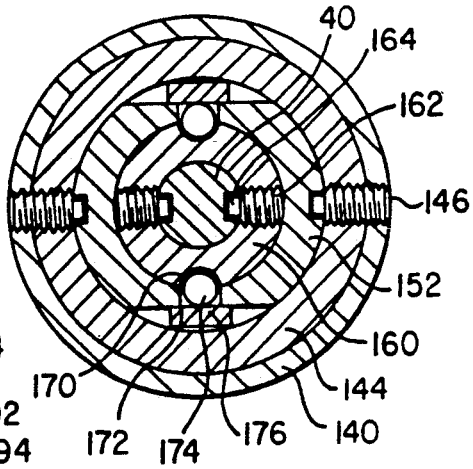
FIG. 6 is a cross sectional view of the rotary-to-linear actuator of either FIG. 4 or FIG. 5 taken along section line 6—6.

Referring again to FIG. 4, both rotary and linear actuation of plate 100 and corresponding poppet valves which are contacted by the plate with linear movement can be more fully understood. Located within cylindrical dust cover 36 and circular top dust cover 38 is an inventive linear-to-rotary actuation cylinder 140. Cylinder 140 is fluidly sealed at one end to interposed member 34 and at the other end to top member 142. Rigidly fastened within linear-to-rotary actuation cylinder 140 is a cylindrical centering sleeve 144 which is held against rotation and against linear motion with fastening means 146, which may be a set screw 146. The opening for set screw 146 is also made fluid tight using static seals 148 and 150 on either side of set screw 146. Interior to centering sleeve 144 and sized for close slip fit with the interior surface of centering sleeve 144 is linearly sliding sleeve 152. Sliding sleeve 152 is held, with the tip of set screw 146, against rotary motion. However, with the use of elongated groove 154, sliding sleeve 152 is moveable in a linear or axial direction. Sleeve 152 slides in fluid sealing fashion using sliding seals 156 and 158 on either side of groove 154. Interior to sliding sleeve 152 is a rotary sleeve 160 which is in fluid sealed rotational engagement with interposed member 34 at one end and with top plate 142 at the other end. Specifically with reference with FIG. 6, it is seen that rotary sleeve 160 is held or keyed to actuation shaft 40, for rotation therewith, as with set screw 162. Actuation shaft 40 moves linearly independent of rotary sleeve 160 as the tip of screw 162 rides in a linearly formed groove 164 in actuation shaft 40. Set screw 162 is again fluidly sealed using slidable sealing rings 166 and 168. With this arrangement, actuation shaft 40 can move linearly up and down with respect to rotation sleeve 160, but must rotate with rotation sleeve 160.

Rotational motion of actuation shaft 40 for the purpose of appropriately positioning plate 100 for actuation of poppet valve 61, is uniquely achieved using helical grooves 170 in sleeve 160, a corresponding hole 172 in linear sliding sleeve 152, and a ball bearing 174 interposed in groove 170 and hole 172. Ball bearing 174 is held in place in sleeve 152 with block 176. Moving sliding sleeve 152 upwardly causes the bearing 174 to roll up helical groove 170 there imparting clockwise rotation to rotary sleeve 160, which in turn, imparts rotation to actuation shaft 40 without imparting any linear actuation to shaft 40. When linear sliding sleeve 152 is moved downwardly without rotation, then ball bearing 174 is rolled down along helical groove 170 thereby imparting counter-clockwise rotation to rotary sleeve 160 and thereby rotation to shaft 40.

As each of the various sleeves of the actuator is fluidically sealed with respect to the others and as only sleeve 152 is free to move in an axially direction, pressurizing lower chamber 178 will force sleeve 152 to move upward while pressurizing upper chamber 180 will cause sleeve 152 to move downward. The amount of linear motion of sleeve 152 is controlled using stop sleeves 182 and 184. The height of the stop sleeves can be sized to precisely adjust the extent of the motion of sliding sleeve 152 to provide the proper amount of linear motion corresponding to the desired angular displacement which will result from helix groove 170. Thereby, according to the invention, plate 100 can be moved radially in precisely 30° increments where there are six poppets. Increments of 15° can be obtained with proper sizing of stop sleeves 182 and 184 where there are twelve poppets.

The pressure to chamber 178 and to 180 is controlled with pilot fluid pressure control means 116 through conduits 186 and 188, respectively. Pilot fluid pressure control means 116 in the embodiment shown in FIG. 4 will have a portion 192 thereof specifically for controlling pressure to chamber 180, i.e., counter-clockwise rotation pilot pressure and a separate portion 194 for controlling pilot pressure to chamber 178, i.e., clockwise rotation pilot pressure.

It is an advantage of the invention hereof that no rotation of plate 100 occurs while plate 100 is linearly actuating any of the poppets through contact directly or through contact with the rocker arms 102. One reason is that excessive wear can occur. Another reason is that the pilot force for causing clockwise or counter-clockwise rotation will be excessive if frictional contact exists between plate 100 and rocker arm 102. Also, in the event that one of the rocker arms is in a void or an opening in plate 100, any rotation could jam the plate against the rocker arm or against the poppet if it is directly actuated. Thus, a position sensing plate 196 is attached to actuation shaft 40 for rigid rotation and linear actuation therewith. Linear sensing means 198 is provided to determine whether actuation shaft 40 is up, (i.e., activated as shown in FIG. 4) or is down (i.e., not actuated). Rotational position sensors 200 and 195 (as shown in FIG. 1) determine whether the shaft is in a clockwise or counter-clockwise position. Information from the sensors is fed to controlling circuitry, which may for example be electrical controlling circuitry, as shown in FIG. 15*a*, 15*b*, 15*c* and 16*a* and 16*b*, or pneumatic control circuitry, as shown schematically in FIG. 17.

Figure 10:
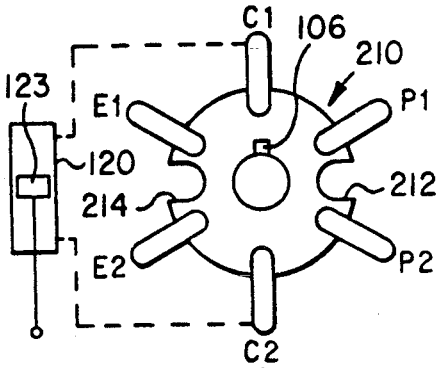
FIG. 10 is a schematic depiction of a alternative pre-programmed plate for providing an open neutral with linear action (closed neutral without linear action)
Figure 11:
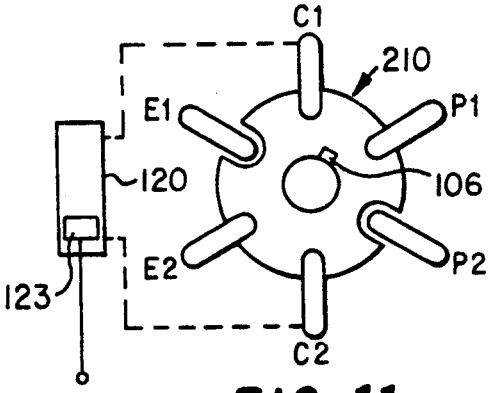
FIG. 11 shows the pre-programmed plate of FIG. 10 rotated one operational sector clockwise resulting in extension of a piston from a working cylinder.
Figure 12:
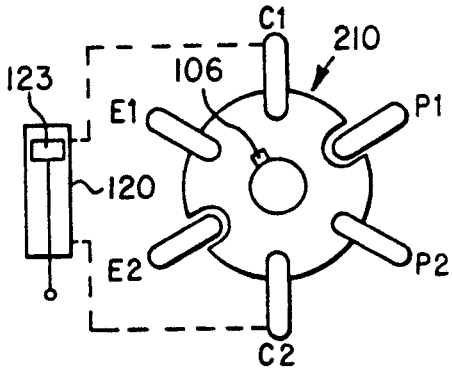
FIG. 12 is a schematic view of the pre-programmed plate of FIG. 10 with one sector counter-clockwise rotation resulting in retraction of a piston into a cylinder.

Turning now to FIGS. 10, 11, and 12, which depict an alternative actuation plate 210 which is pre-programmed with two diametrically opposed cut out portions 212 and 214 at 90° to key way 106 which is vertically adjacent poppet control C1 for the first side of the cylinder 120 when plate 210 is in a neutral condition. Plate 210 allows for either an open neutral condition, if plate 210 is linearly activated, or a closed neutral condition without linear actuation of plate 210. It is noted that a closed neutral condition is available with any plate configuration without linear action of the plate as the poppet valves are naturally biased closed and without actuation thereof will remain in a closed neutral condition.

Referring to FIG. 11, with plate 210 rotated 30° clockwise piston 123 in cylinder 120 is actuated downward due to pressure being connected between P1 and C1 while the second side of the cylinder 120 being exhausted through the connection of C2 and E2 by actuation of the corresponding poppets.

Referring to FIG. 12, which depicts plate 210 in a 30° counter-clockwise rotation, cylinder 120 is pressurized on the second side thereof and exhausted on the first side thereof so that piston 123 moves upwardly.

Figure 13:
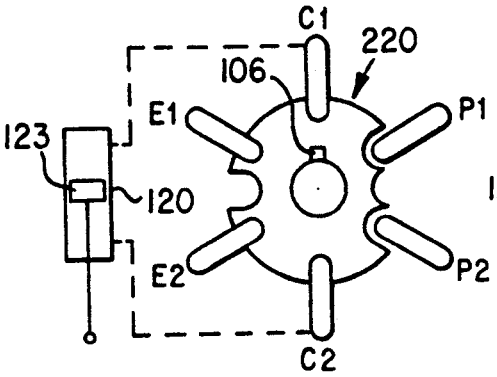
FIG. 13 is a schematic representation of an alternatively pre-programmed plate for providing float neutral condition when the plate is linearly actuated (one sector clockwise rotation of the plate of FIG. 13 provides extension of a piston or working cylinder while one sector rotation in the counter-clockwise direction provides retraction of the piston)

Referring to FIG. 13 which depicts an alternative plate 220 in its centered condition or neutral condition. When plate 220 is linearly actuated a float neutral condition results from the cut out arrangement as shown. Cut out areas of plate 220 correspond to sectors 2, 3, 4, and sector 9 of FIG. 7. Thus, in the centered position either side of cylinder 120 is connected to exhaust such that piston 123 may float in either direction provided that both exhaust reservoirs E1 and E2 are such that suction caused by movement of piston 123 in cylinder 120 will bring in exhaust fluid through the opened poppets E1 and E2 and in through cylinders poppets C1 and C2. Although FIGURES are not shown with counter-clockwise and clockwise rotation of plate 220, it can be seen that 30° clockwise rotation of plate 220 of FIG. 13 followed by linear actuation causes the first side of cylinder 120 to be pressurized and the second side to be exhausted such that the piston 123 moves downwardly. Rotating plate 220 counter-clockwise 30° from its centered position followed by linear actuation will result in the second side of cylinder 120 being pressurized while the first side is exhausted thereby moving piston 123 upward.

Figure 14:
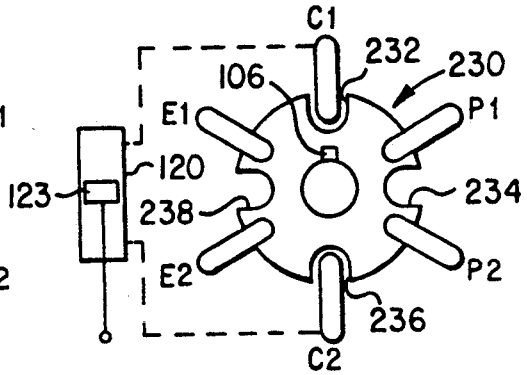
FIG. 14 shows another alternative pre-programmed plate for providing a tandem neutral condition when linearly actuated (one sector clockwise rotation moves a piston outward while one sector counter-clockwise rotation moves the piston inward.

Referring to FIG. 14, an alternative plate 230 is depicted wherein its centered position is shown with key 106 correspondingly located at poppet position C1. Cut out 232 is located at cylinder C1 control position, cut out 234 is at a position 90° clockwise therefrom, cut out portion 236 is at a position 180° clockwise from cut out 232, and cut out portion 238 is 270° clockwise from cut out 232. In the centered position shown in FIG. 14 a tandem neutral condition is achieved by linear actuation of plate 230. A tandem neutral condition is one in which both sides of the piston C1 and C2 are closed during neutral such that a fluidic lock results and no piston motion can be obtained. Thus, the piston will hold in the last position prior to placing plate 230 in the neutral position. Further, in the tandem neutral condition the pressure P1 is continuously connected to exhaust E1 while pressure P2 is continuously connected to exhaust E2. While the clockwise and counter-clockwise positions are not depicted in FIG. 14, it can be seen that rotation by 30° clockwise will pressurize the first side of cylinder 120 thereby moving the piston 123 downwardly while counter-clockwise rotation 30° from the neutral or centered position will pressurize the second side of cylinder 120 while the first side is exhausted thereby moving piston 123 upwardly.

Figure 5:
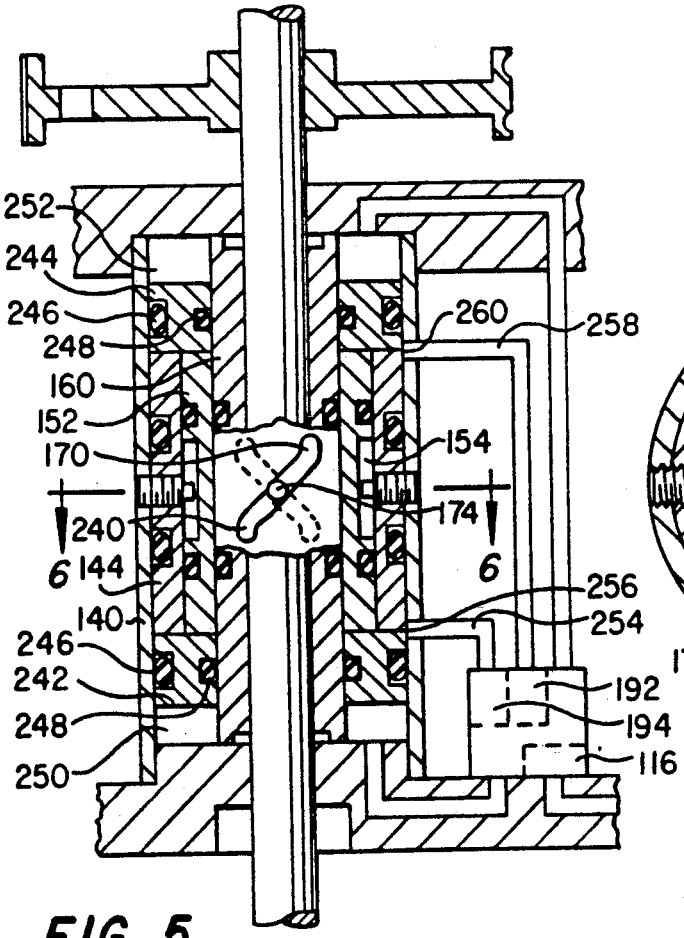
FIG. 5 is a partial cross sectional view of an alternative embodiment of a rotary-to-linear actuator according to the present invention.
Figure 22:
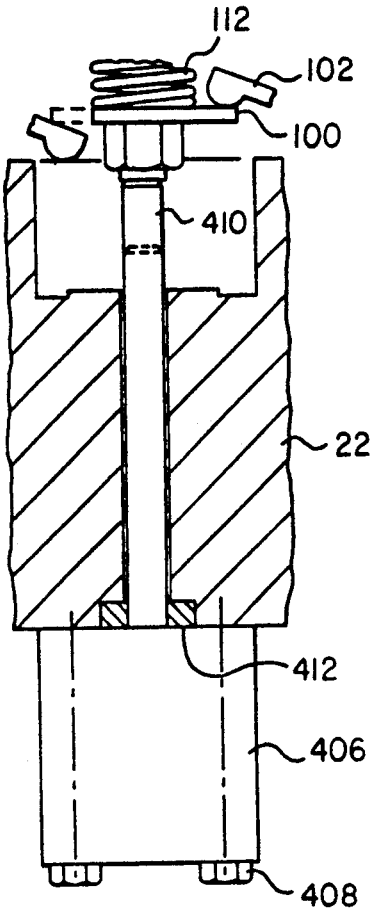
FIG. 22 is a partial cross-sectional schematic view of a linear solenoid for linear movement of the actuation plate.

One aspect of each of the alternative selectable plates 210, 220, and 230, as depicted in FIGS. 10 through 14, is that each requires rotation of the plate to three separate rotary positions rather than two as with alternative selectable plate 100 of FIGS. 8 and 9 as such additional rotary control is required. Thus, an alternative embodiment of a linear-to-rotary actuator has uniquely been provided according to the present invention as shown in FIG. 5 which is a cross-sectional view of such alternative actuator mechanism. Each of the elements of linear to rotary actuation cylinder 140, centering sleeve 144, sliding sleeve 152, and rotary sleeve 160 all continue to operate with the same types of linear or rotary sliding action with respect to each other as with the linear-to-rotary actuator of FIG. 4. However, helical groove 170 is extended with a lower groove portion 240 such that rotary sleeve 160 can be rotated either 30° clockwise or 30° counter-clockwise of the center position shown. Also the centered position is obtained by providing lower ring piston 242 and upper ring piston 244, both of which are sized for sliding sealed engagement with the interior surface of actuator cylinder 140 and with the exterior surface of rotary sleeve 160. Sealing means 246 and 248 are provided typically on each ring piston 242 and 244. To obtain the centering neutral position chamber 250 below the lower ring piston 242 is pressurized simultaneously with pressurizing upper chamber 252 above upper ring piston 244. This acts to force the sliding sleeve 152 directly adjacent centering sleeve 144. In order to move the sliding sleeve 152 upwardly, pilot control pressure is provided through conduit 254 to the gap 256 above lower ring piston 242. This pilot pressure acts to force ring piston 242 downwardly while it forces linear sliding sleeve 152 upwardly when the pilot pressure in gap 256 is greater than the pilot pressure in chambers 250 and 252. In order to move sliding sleeve 152 downwardly and thereby rotate member counter-clockwise through the use helical groove 170, pilot pressure is provided from pilot control 116 through conduit 258 into gap 260 while the pressure is reduced in chambers 250 and 252. In this manner, operating similarly to the linear-to-rotary actuator described previously in connection with FIG. 4, all three rotary positions (counter-clockwise, center, and clockwise) can be obtained as desired for rotation of actuator shaft 40 as in FIG. 5. Again, rotation of shaft 40 thereby rotates the selected and connected pre-programmed control plate 210, 220 or 230 as the case may be. After the rotation is completed to the appropriate rotary position, pilot pressure is provided to linearly actuate the plate against the appropriately aligned poppets. In the preferred embodiments shown in FIGS. 4 and 5, pilot pressure is advantageously used to control rotary and linear actuation of shaft 40. It has also been discovered that in some situations pilot fluid control might not be considered advantageous, as where a pilot source pressure is not conveniently available. Thus, as will be explained with reference to FIGS. 18, 19, 20, and 21 below, an electrical rotary actuator can be used to provide appropriate clockwise, counter-clockwise, and centering of the control shaft 40. The embodiment shown in FIGS. 16*c* and 18–20 provides a stepper motor with a finite number of steps either clockwise or counter-clockwise. The embodiment shown in FIGS. 16*d* and 21 provides another alternative with a rotary solenoid. In each case an electrical solenoid means as shown in FIG. 22 may be used for linear actuation of shaft 40 without pilot pressure. In all cases the rotary movement of the actuation plates as well as the linear movement of the actuation plates will beneficially be the same as previously described to achieve the operating conditions as well as the operation neutral conditions associated with each of the interchangeable pre-programmed actuation plates.

Figure 15A:
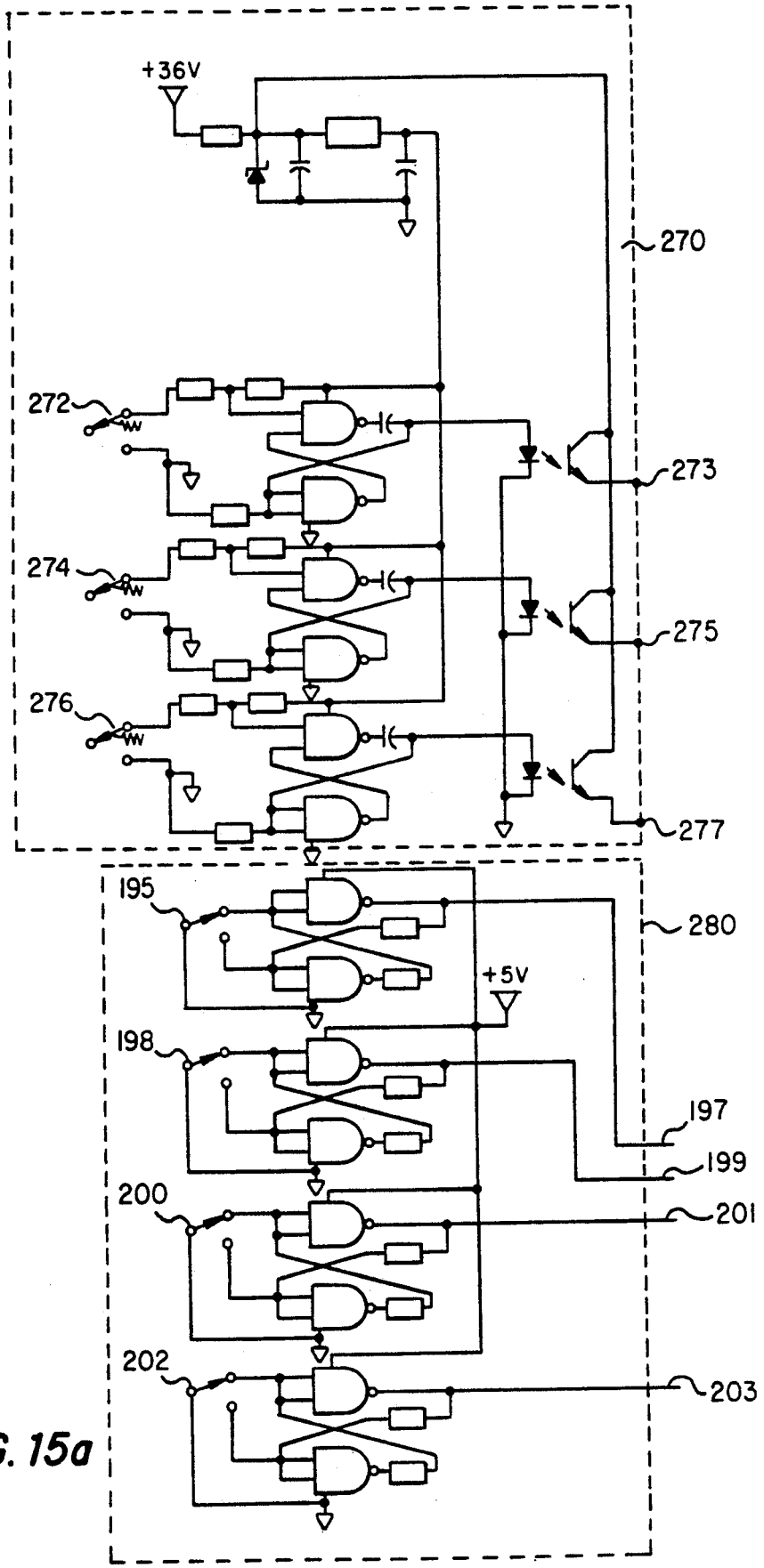
FIG. 15*a* is a schematic diagram of the portion of the processor control circuitry showing the input circuits and leads into the processor logic circuit of FIG. 15*b;*
Figure 15B:
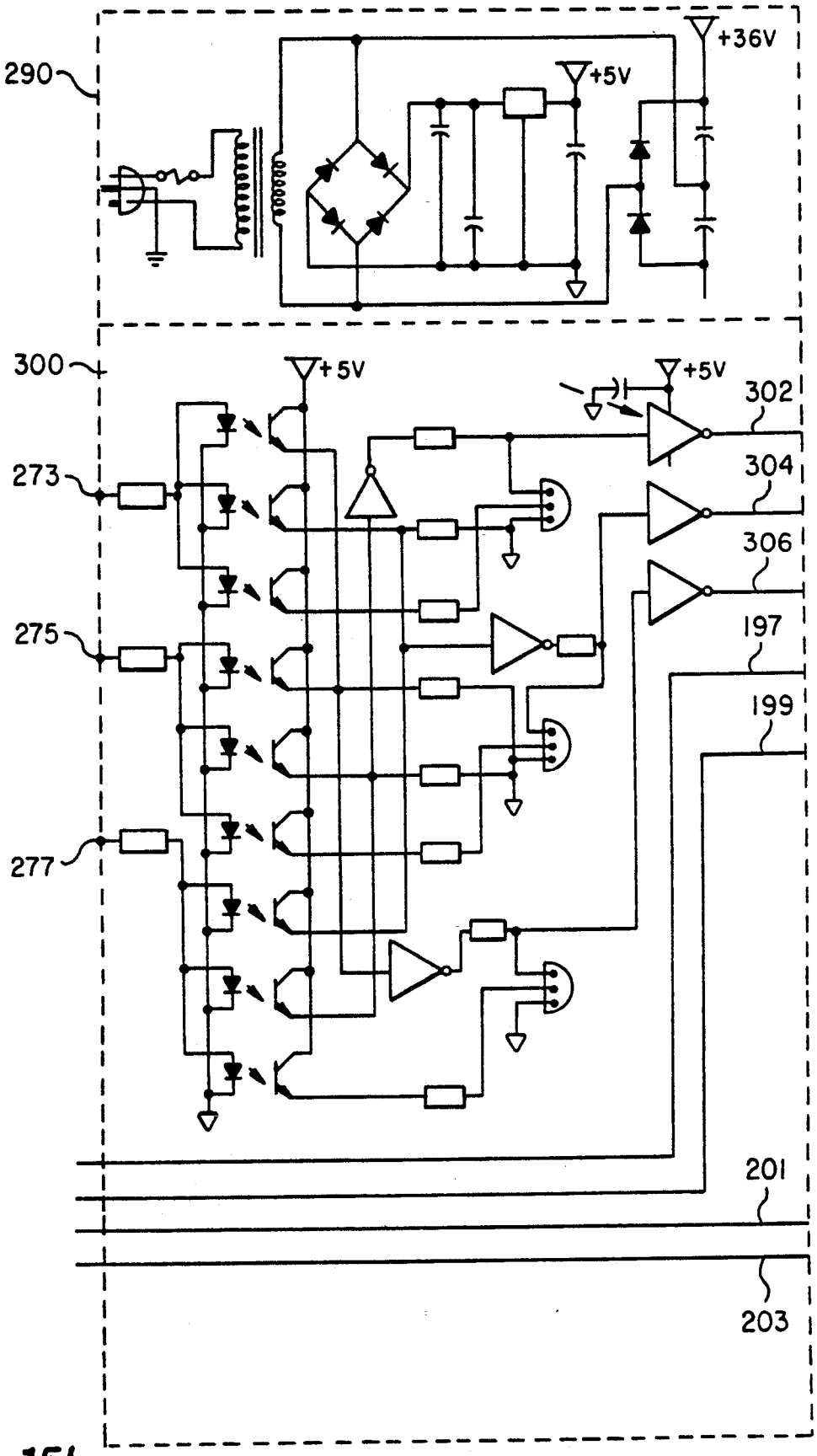
FIG. 15*b* is a schematic diagram of the portion of the processor control circuitry showing the power circuits and the logic circuits for the processor which logic circuits receive the input signal from the leads of FIG. 15*a;*
Figure 15C:
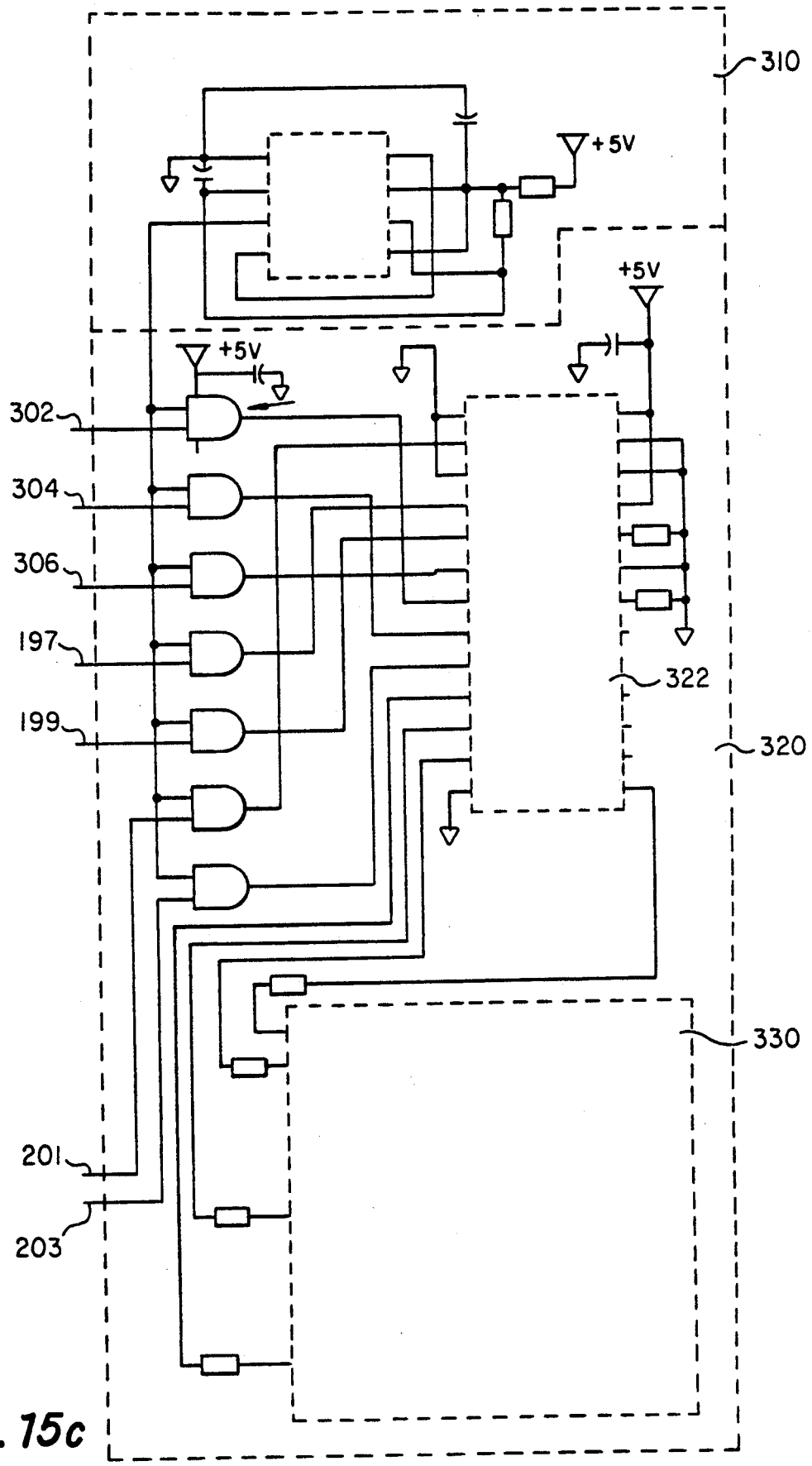
FIG. 15*c* is a schematic diagram of the portion of the control processor circuitry showing the output logic to alternative actuation circuits FIG. 16*a* and FIG. 16*b* which will be inserted into the block represented by dashed lines.

The electronic control circuitry for controlling the rotary and linear actuation of the alternative designs for the actuation plates depicted in FIGS. 8 through 14 may be more fully understood with reference to FIGS. 15*a*, 15*b*, 15*c*, and FIGS. 16*a*, 16*b*, 16*c*, and 16*d*. In each of these FIGURES portions of the control circuity which are for various generally distinct purposes are enclosed in dashed lines for discussion purposes, with electrical inter-connection between the various portions indicated at the dashed line imaginary border between each portion. In FIG. 15*a*, operator control circuit portion 270 is depicted adjacent to position sensing circuit portion 280. In FIG. 15*b*, the power circuit portion 290 and the control logic circuit portion 300 are depicted. FIG. 15*c* depicts clock circuitry portion 310 and pre-programmed rom circuitry portion 320 with alternative actuator circuitry portion 330 corresponding to one of the alternative designs depicted in either FIGS. 16*a*, 16*b*, 16*c* or 16*d*.

Referring to the drawings 15*a*, 15*b*, and 15*c*, and 16*a*, 16*b*, 16*c*, and 16*d*, it will be seen that the power supply circuit 290 provides a bounceless high or low logic out put depending on the throw of position sensing switches 195, 198, 200, and 202, it being understood that sensing switch 202 would not be required for a two position rotary actuation plate (FIGS. 8 and 9) but would be required for the three position rotary actuation plates (FIGS. 10–14). The one shot touch switches 272, 274, 276 are actuated by the valve user at a distance of up to 100 feet from the valve such that activation of 272 calls for piston up, 274 calls for neutral position, and 276 calls for piston down thereby providing appropriate signals at terminal 273, 275, and 277 in conjunction with the signals provided by sensing switches 195, 198, 200, and 202 for logic control of rotation and linear actuation.

Referring to FIG. 15*b*, signals 273, 275, and 277 from switches 272, 274, and 276 of FIG. 15*a*, are input into the logic relay circuit 300 which recognizes which of the three touch switches was pulsed and utilizing the power supply circuit portion 290 provides a high logic output on the proper output conductor 302, 304 or 306. When logic relay circuit 300 receives a new pulse, logic inverters and SCRs are used to disable the circuit to be inactivated by breaking power to the SCR anode connection while power to the active circuits SCR is initiated by the same pulse to the corresponding gate. The anode of the active SCR is common with an input load resistor and with an output which go to a logic low. Since the cathode of the active SCR is grounded, its output in the logic relay 300 goes high from a logic invertor in its output.

Referring to FIG. 15*c*, gates are provided in the rom circuit 320 for receiving the power supply signal, the inputs from the touch switches as relayed through logic relay 300 and the inputs 197, 199, 201 and 203 from the position sensing switches 195, 198, 200 and 202. Also input high and low pulses are received from timer circuitry 310 to provide either high or low outputs to the pre-programmed rom 322. The rom uses these input signals to provide outputs to circuitry as in FIG. 16*a*, FIG. 16*b*, FIG. 16*c* or in FIG. 16*d*.

Figure 16A:
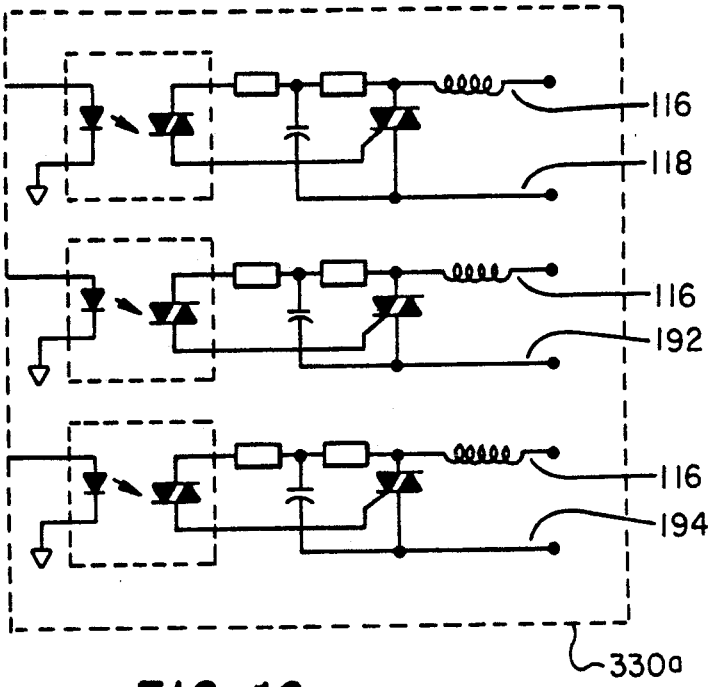
FIG. 16*a* is a schematic diagram of one alternative portion of the processor circuitry which receives output logic from the circuit of FIG. 15*c* and showing actuation output circuitry for controlling rotary positioning and linear movement of the actuation plate according to the present invention for close neutral as in FIGS. 8 and 9.

Referring now to FIG. 16*a*, triac circuit 330*a* appropriately responds to outputs from rom 322 to appropriately enable or disable the portions 118, 192 or 194 of pilot fluid control means 116 of FIG. 4 to appropriately actuate the actuator plate 100 of FIGS. 8 and 9 to obtain the desired poppet valve operating condition as previously described.

Figure 16B:
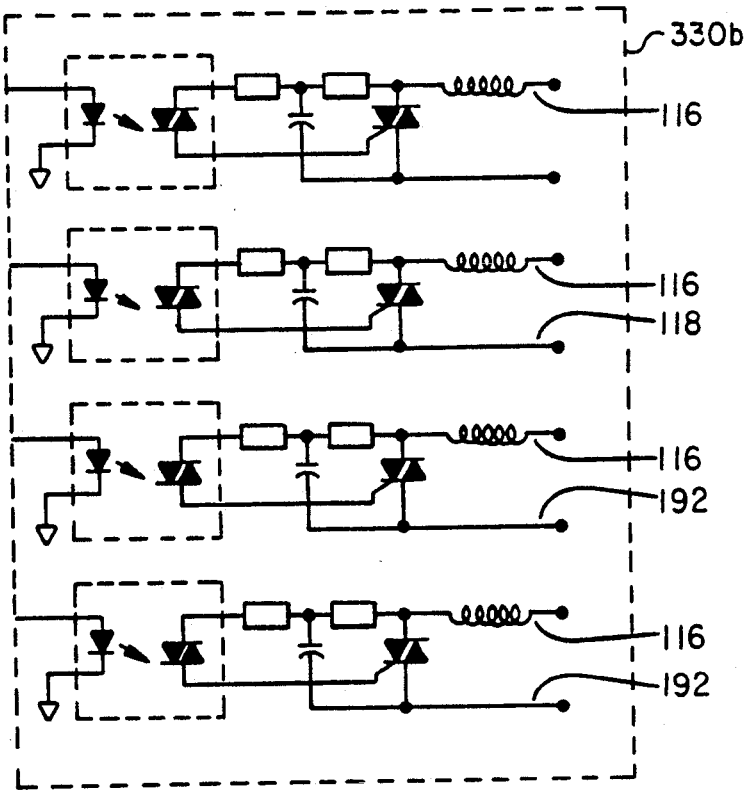
FIG. 16*b* is a schematic diagram of another alternative portion of the processor circuitry for receiving logic from FIG. 15*c* and for providing actuation output for rotary positioning and linear movement of the actuation plate according to the present invention.

Referring to FIG. 16*b* an alternative embodiment triac circuit 330*b* appropriately responds to outputs from rom 322 to appropriately enable or disable the centering portion 119, and the portion 118, 192, and 194 of pilot control fluid control 116 of FIG. 5 to appropriately actuate alternative actuator plates 210, 220 or 230 of FIGS. 10–14 to obtain the desired poppet valve operating condition.

Figure 16C:
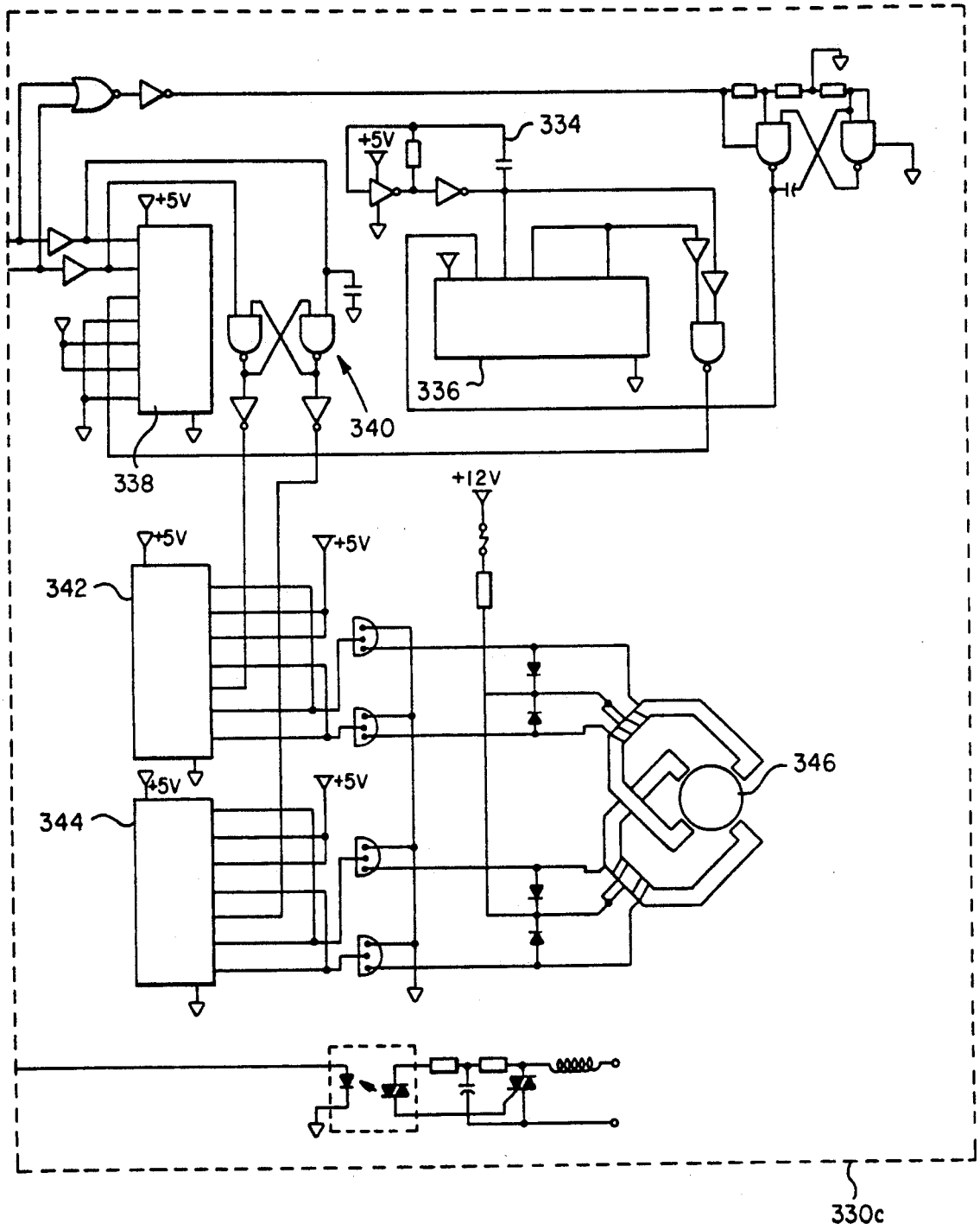
FIG. 16*c* is a schematic diagram of another alternative portion of the processor circuitry for receiving logic from FIG. 15*c* and for providing actuation output for the operation of stepper motor control for rotary positioning and linear movement of the actuation plate according to an alternative for the first embodiment of the present invention.
Figure 16D:
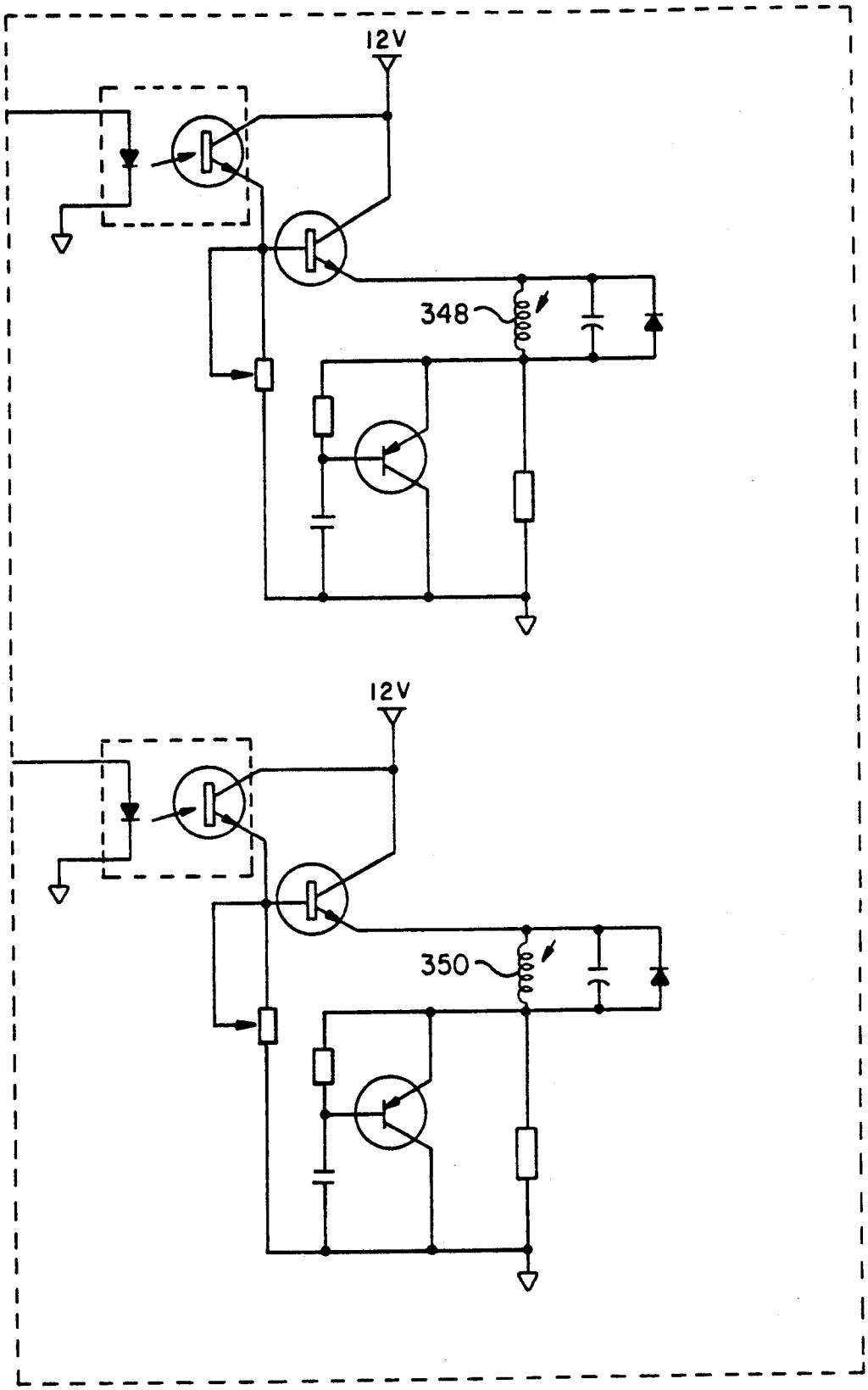
FIG. 16*d* is a schematic diagram of another alternative portion of the processor circuitry for receiving logic from FIG. 15*c* and for providing actuation of rotary and linear solenoids for rotary positioning and linear movement of the actuation plate according to another alternative for the first embodiment of the present invention.

Referring to FIG. 16*c*, an alternative embodiment of actuator plate control circuitry 330*c* receives the output of rom 322 to appropriately actuate the electrical step motor rotary actuators as shown below in FIGS. 18–20 and the linear solenoid of FIGS. 16*a*–16*b*. In this embodiment circuitry 330*c* is composed of an initializer 332 which provides one pulse to reset a counter 336 when either a counter-clockwise or a clockwise input to circuit 330*c* goes from low to high logic. A clock 334 which provides pulses to counter 336. A J-K flip flop 338 is wired to toggle outputs Q and Q at one-half the input rate of the clock pulse received from counter 336. An R-S flip flop 340 toggles the Q and Q outputs from the J-K flip flop 338 to provide out of phase outputs with the leading and lagging phase established according to which input has been established low by the counter-clockwise or the clockwise input signal. Second J-K flip flop 342 and third J-K flip flop 344 are wired to toggle outputs from R-S flip flop 340 at one-fourth the input rate of clock pulse received from counter 336. The second and third J-K flip flops 342 and 344 thus provide activation of 30° rotation with four steps of 7.5° rotation to the stepper motor 360 which is shown schematically with only four of forty-eight poles.

Referring to FIG. 16*d*, an alternative embodiment plate control circuitry 330*d* (shown schematically) receives the output from rom 322 to appropriately actuate the electrical rotary solenoid a shown below in FIG. 21 and the linear solenoid of FIG. 22. The circuit 330*d* allows high current through the solenoid 348 until it pulls in the load. The current is then decreased to enable the load to be held while reducing the heating of the solenoid coil for continuously energizing the solenoid at full load operating condition. A duplicate circuit is provided for actuating the direct linear solenoid 350.

Both solenoid armatures are spring returned for the second operating condition.

The pre-programming assures that any given actuator plate is maintained linearly at rest clear of the rocker arms before any rotation occurs. This assures that no rotation of the plate will occur as long as it is moved away from its at rest position.

Figure 17:
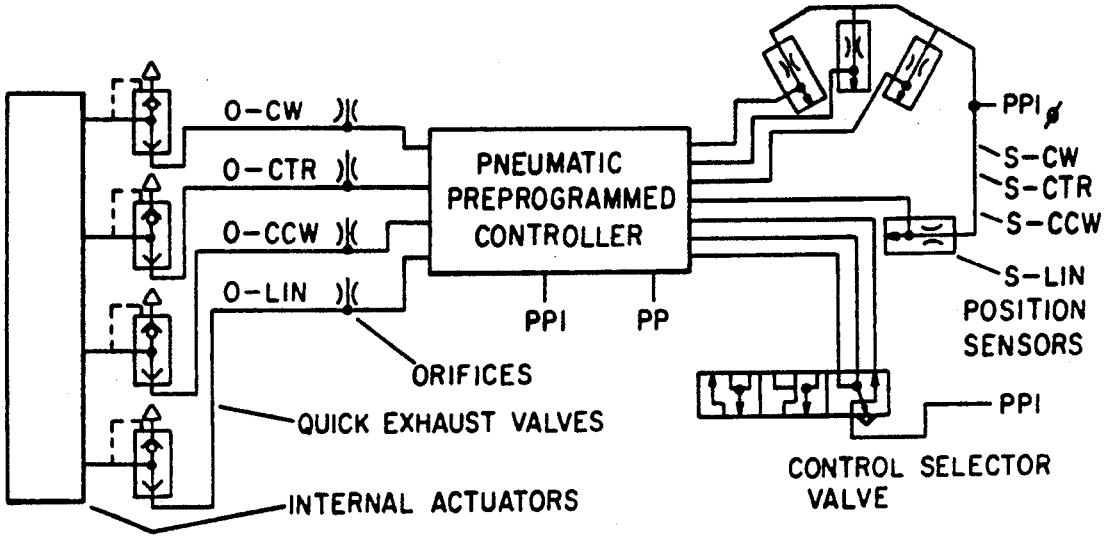
FIG. 17 is a schematic diagram of a pneumatic pre-programmed controller with control selector valves, pressure sensing switches, and a pneumatically operated pre-programmed controller for pilot pressure actuation for rotary positioning and linear movement of the actuation plate according to another alternative for the first embodiment of the present invention.

With reference to FIG. 17, a schematic diagram of a pneumatic pre-programmed controller is depicted in which the control switches are replaced with control selector valves and in which the electronic position sensing switches are replaced with pressure sensing switches and the electronic circuitry is replaced with a pneumatic pre-programmed controller which operates to provide clockwise pressure or centering pilot pressure or counter-clockwise pressure and/or linear motion pilot pressure directly from pilot pressure source according to the required functions as previously described.

Figure 18:
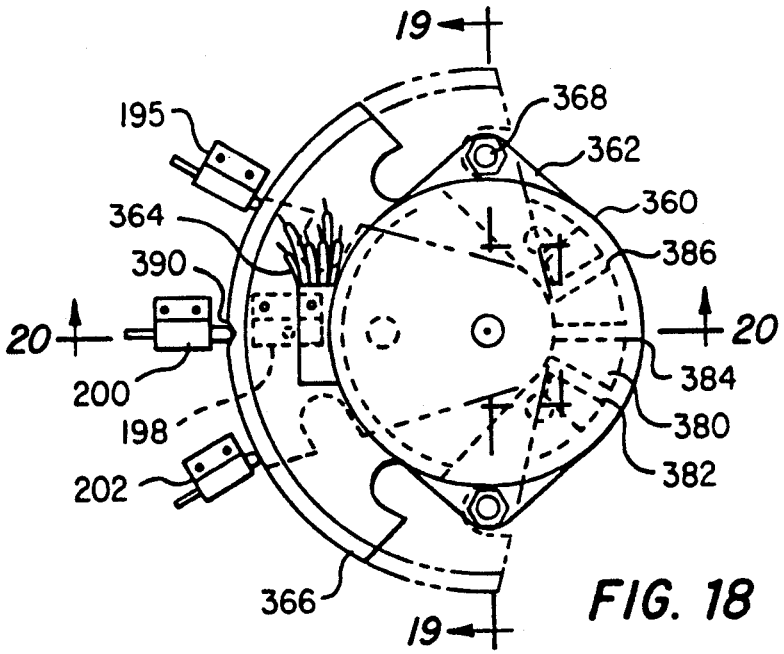
FIG. 18 is a top plan view of a stepper motor for rotary actuation of the present invention.

FIG. 18 which shows a top plan view of the alternative embodiment including a stepper motor 360. The stepper motor 360 is connected to the valve body through mounting plate 362. The stepper motor is provided with electrical energy source and controls (as set forth in FIGS. 15*a–c* and 16*c*) through a electrical control bundle 364. A position sensing plate 366 is attached so that the amount of rotation provided by stepper motor 360 can be detected using the same type of sensing switches 195, 200, and 202 as with the embodiment shown previously in FIGS. 1 and 4. The up and down motion of the position sensing plate 366 can also be determined with sensing switch 198 as will be more fully understood with reference to FIG. 20 below.

Figure 19:
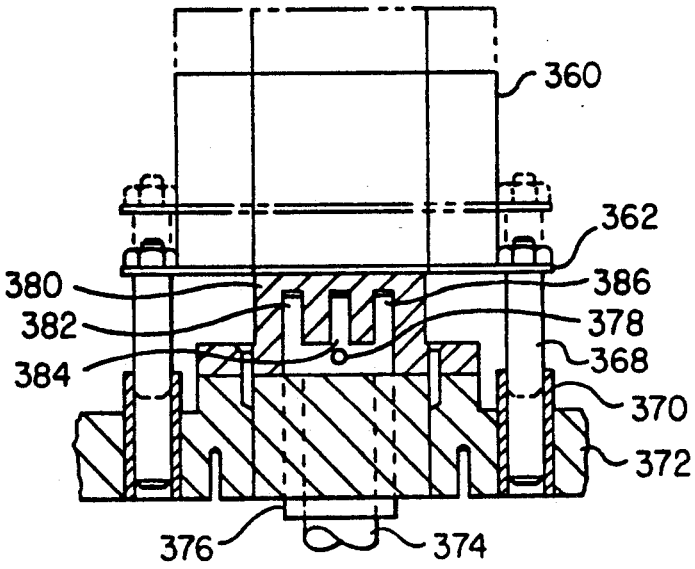
FIG. 19 is a partial cross-sectional schematic view of the stepper motor of FIG. 18 taken along section line 19—19.

Referring to FIG. 19, it can be seen that the entire stepper motor 360 is mounted for linear motion through mounting plate 362 on polished rods 368 which are slidably engaged in slide bearing sleeve 370. The slide bearing sleeves 370 are affixed in alternative interposed member 372 which mounts to the valve assembly body 22 (not shown in FIG. 19). The poppet valves are again actuated through alternative actuator shaft 374 which is provided with both linear sliding and rotational movement through support bearing 376. It being understood that the actuation plates as described in connection with FIGS. 8–14 are connected to actuator shaft 374. Actuator shaft 374 can be linearly actuated either using pilot pressure control as discussed above or other linear actuation control such as the linear solenoid described below in connection with FIG. 22.

Figure 20:
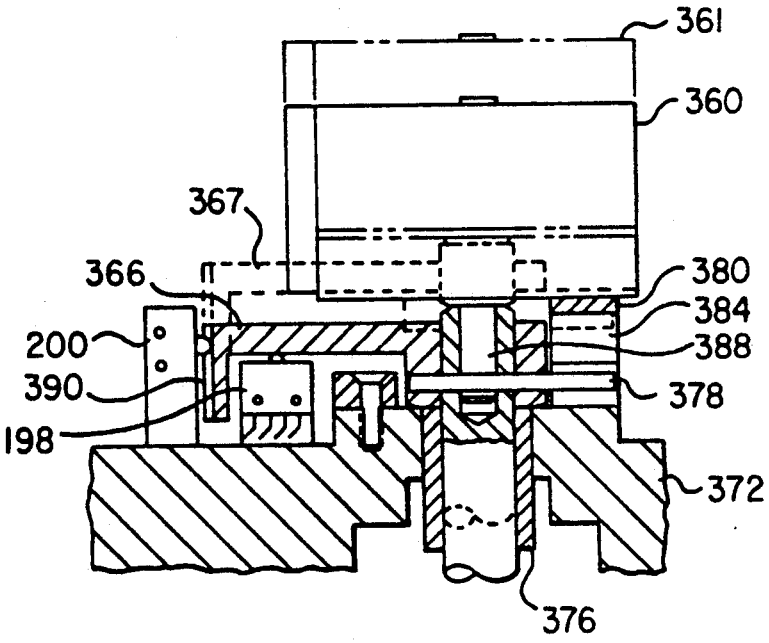
FIG. 20 is a partial cross-sectional front view of the stepper motor taken along section line 20—20 of FIG. 18.
Figure 21:
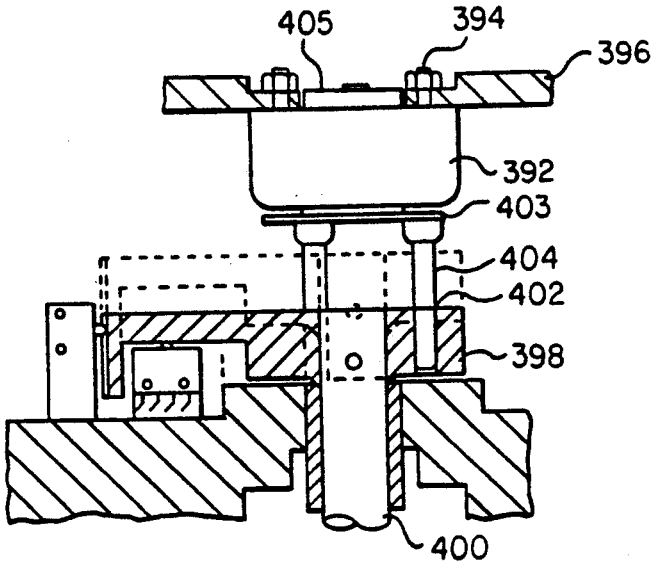
FIG. 21 is a schematic cross-sectional depiction of a rotary solenoid for rotary actuation control.

With reference to both FIGS. 19 and 20, it can be more fully understood that there is a stop pin 378 inserted through actuator shaft 374 as well as through stepper motor shaft 388 and position sensing plate 366 thereby holding all such members in linear and rotational engagement with one another. There is a stop slot plate 380 mounted to alternative interposed member 372 having formed therein first slot 382, second slot 384, and third slot 386. With reference to FIG. 18, each slot 382, 384, and 386 project radially from the center of actuator shaft 374 and each is angularly disposed with respect to one another corresponding to the appropriate rotary positions. Thus, for an assembly with six poppet valves each slot is 30° from the next slot and in the case of a poppet valve assembly having twelve poppets each slot would be 15° from each other slot. Thus, when stop pin 378 is rotated as shown in FIG. 19 to the center slot 384, linear actuation can take place with respect to actuator shaft 374 and pin 378 slides vertically into slot 384. In this manner the linear actuation can only take place when the stop pin is in alignment with one of the slots and no rotary actuation can occur when there is linear actuation.

In FIGS. 19 and 20 it can be seen, with phantom lines 361, that the stepper motor can move upwardly due to linear actuation in which case the sensing plate 366 moves and is positioned as shown with phantom lines 367. The rotary position of the sensing plate can continue to be detected in either the upward or the downward linear actuation position as a detent groove 390 is provided in the surface of plate 366.

With reference to FIG. 21 another alternative embodiment is depicted in which rotary solenoid 392 is rigidly mounted through fasteners 394 to a structure 396 which is adjacently positioned from the valve body 22. Once again a position detection plate 398 is rigidly affixed to an alternative actuation shaft 400. The sensing plate 398 is provided with vertical holes 402 located off center from the shaft 400. A rotary solenoid has an armature plate 403 with projecting rods 404 rigidly attached thereto off center from the center axis of rotary solenoid 392. The rotary solenoid 392 is actuated only for counter-clockwise rotation of plate 100. The armature plate 403 rotates the projecting rods 404 which are inter-connected with holes 402 thereby providing rotation to the sensing plate 398 which transmits the rotation to actuator shaft 400. Projecting rods 404 and holes 402 are sized for slip fit engagement so that limited linear motion of the armature plate is not transmitted to shaft 400. Controlled linear actuation of shaft 400 is also accommodated through sliding engagement between rods 404 and holes 402. A return spring 405 returns the rotary solenoid 392 to its centered position when the actuation power to the rotary solenoid is removed.

Referring to FIG. 22, a linear actuation solenoid 406 is shown rigidly affixed with fastener means 408 to the bottom surface of valve body 22, shown in partially cross section. The solenoid shaft 410 passes through the center of valve body 22 and is sealed and may be provided with a sealing means such as an O-ring 412. In this embodiment the actuator plate 100 is affixed to the bottom of one alternative actuator shaft 400 (while actuator plate 100 and actuator shaft 400 are shown for explanatory purposes alternative actuator plates and shafts can be used as set forth above). Actuator shaft 400 is spring loaded downwardly by biasing means 112. In this manner, rocker arm 102 is shown in an actuated position. When solenoid 406 is de-energized then spring 112 will move plate 100 downward out of contact with rocker arm 102 so that shaft 400 can be rotated to another operating condition before linear actuation is accomplished by again energizing solenoid 406.

Figure 23:
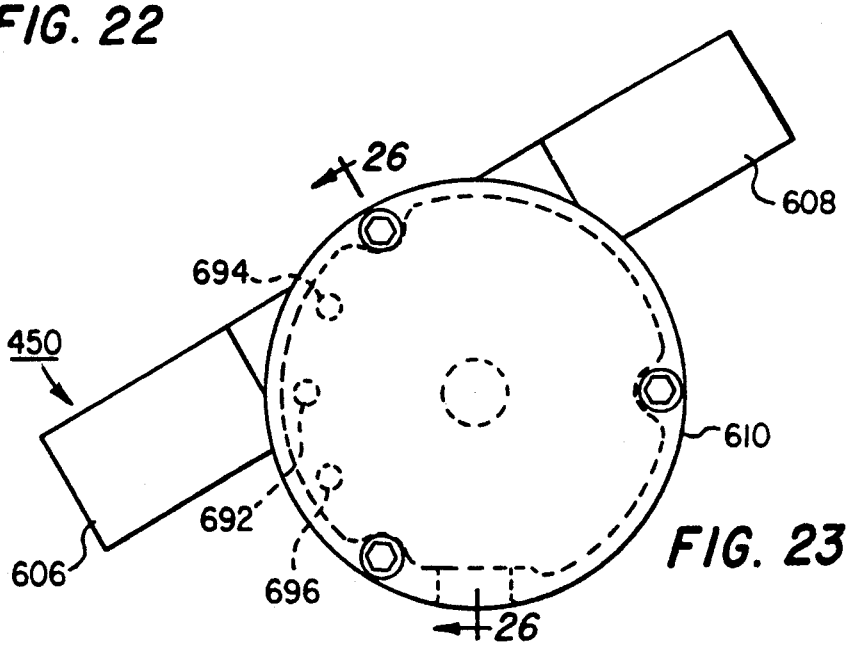
FIG. 23 is an end view of the valve assembly in accordance with a second embodiment of the invention.
Figure 24:
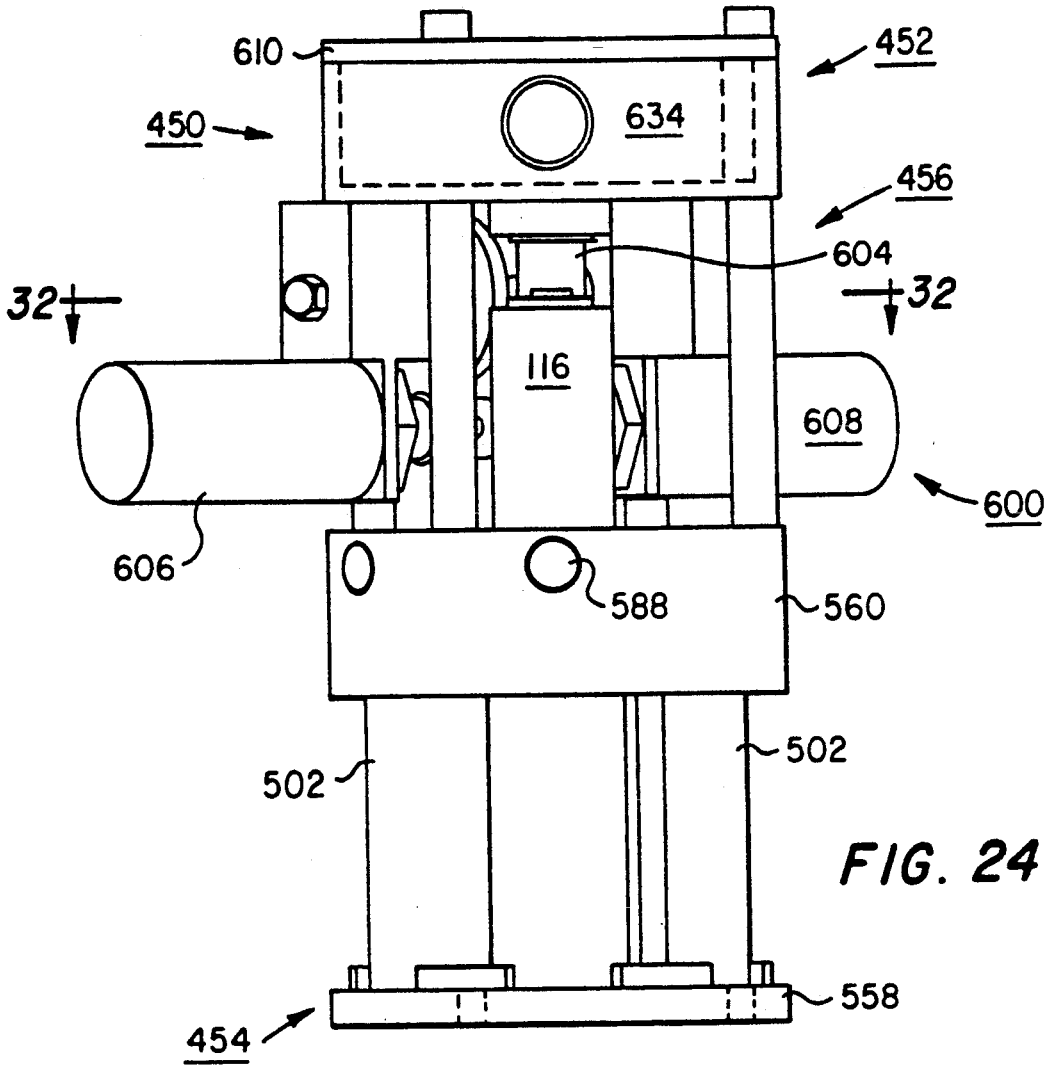
FIG. 24 is a side view of the valve assembly of FIG. 23.
Figure 25:
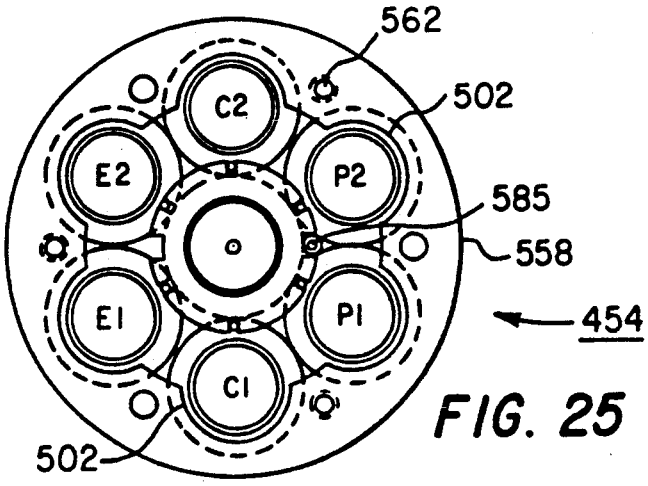
FIG. 25 is an opposite end view of the valve assembly of FIG. 23.

A second embodiment of the valve assembly designated 450 will now be described with particular reference to FIGS. 23–47. Referring initially to FIGS. 23–25, the valve assembly hereof comprises an actuator end 452, a connection end 454 and an actuating unit 456.

Figure 26:
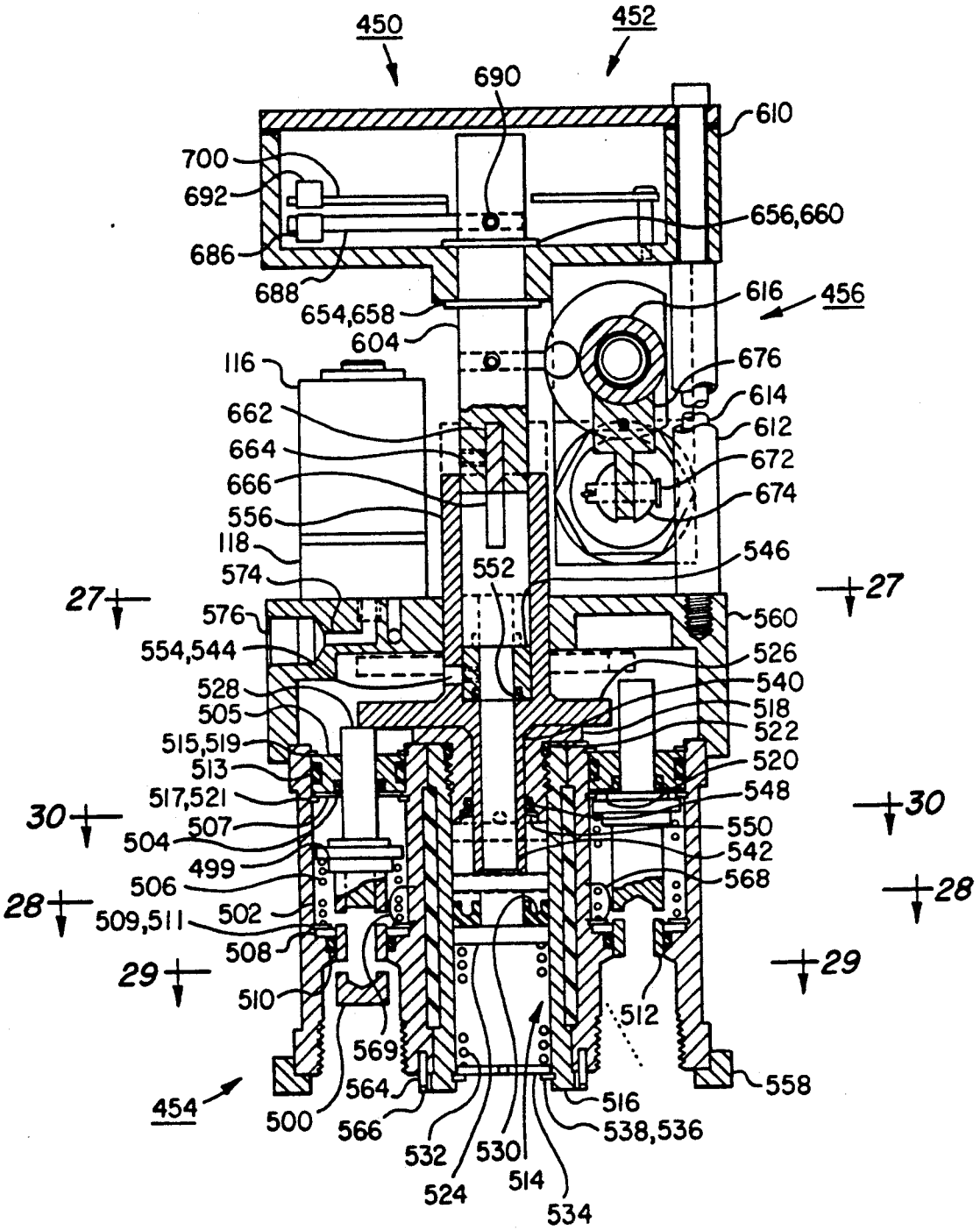
FIG. 26 is a sectional view as taken along the lines 26—26 of FIG. 23.

The connection end 454, as best seen in FIG. 26, includes a normally closed biased plunger valve 500 functionally similar to the poppet valves of the previous embodiment described supra. The valve is constructed of two joined sections shown in a linear actuated position and in sliding communication within cylinder 502. The valve includes a projection 528 extending through a seal 504 disposed within insert 505. The insert in turn is sealed within cylinder 502 by seal 513 and is secured in place by washer 507 and retainer rings 515 and 517 in cylinder grooves 519 and 521 respectively. A spring 506 compressed between a retainer ring 509 in groove 511 and valve flange 499 urges the valve toward its normally closed position. Centrally supporting the valve within the cylinder is a washer 508 and a second seal 510. Also disclosed thereat is a normally opened biased plunger valve 512 (shown in its biased open position) and which functions similarly to the normally closed valve 500 except for the fluid flow control mode as will be understood.

Operation of the individual valves 500 and 512 is effected by a pre-programmed plate 526 that is subjected to biased linear actuation by means of a piston cylinder assembly 514. Comprising the piston cylinder assembly is a small flange 516 secured by a threaded joint 520 and a seal 522. A biased piston 524 is supported in linear sliding communication within the assembly and is shown in its linear actuated position. The assembly is functionally similar to the sealed piston of the prior embodiment described supra except for a direction reversal for actuating the plunger valves 500 and 512. That is, in this arrangement unlike the previous embodiment, alternative pre-programmed plate 526 bears linearly against projections 528 of the valves to effect direct displacement from their normal positions. A large flange portion 518 is removable for providing access to the seals and spring for maintenance or removal of the installed biased piston 524.

Cooperating with piston 524 is a seal 530, biased spring 532, vented bearing plug 534, and a retainer ring 536. The latter is positioned within a groove 538 of the piston cylinder assembly to impart linear actuation to pre-programmed plate 526 when required. Small extension 540 of plate 526 is in linear sliding communication with the piston cylinder assembly as linear actuation is imposed against plate 526. Also provided for imposing linear actuation to the program plate, is a pull rod 542 representing an integral extension from piston 524 that via set screw 544 and coupling 546 imparts the linear bearing force thereto.

During an absence of linear actuation, the end of extension 540 being contacted by the piston causes the pre-programmed plate to be biased clear of valve projections 528. When in this normally biased relation, the small clearances between the bearing surfaces afford minimum resistance to rotary operation between the plate 526 and pull rod 542. A seal 548 retained by spring washer 550 and seal 552 preclude leakage of pressurized pilot fluid from the piston assembly 514. An opening 554 through large extension 556 of plate 526 provides access to set screw 544.

Figure 28:
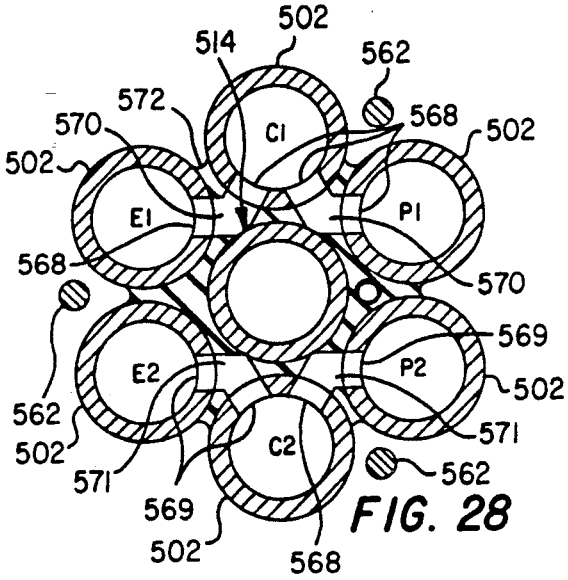
FIG. 28 is a sectional view as taken along the lines 28—28 of FIG. 26 with the plunger valves removed.

With reference also to FIG. 28, it can be seen that the concentrically arranged individual valve cylinders 502 are identically sized and closely nested. Small flange portion 516 and removable flange portion 518 of the piston cylinder assembly 514 serve to constrain the cylinders against axial movement. An end cap 558 and interposed member 560 secure the relative positions of the cylinders and are in turn held in a bearing relation with the cylinders by tie bolts 562. Pins 564 in bearing relation with mounting slots 566 secure each of the cylinders against rotational displacement.

For interconnecting the individual cylinders in order to effect parallel flow in the manner of the prior embodiment described supra, cylinders designated E1, C1, and P1 are grouped together and interconnected via apertures 568 and intervening ducts 570 located within sealing material 572. Similarly, cylinders E2, C2, and P2 represent the opposite group and are interconnected via their respective apertures 569 and intervening ducts 571.

Figure 27:
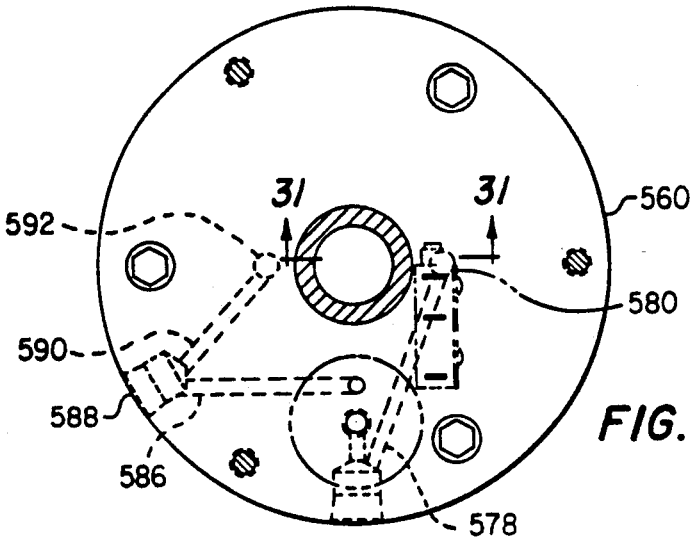
FIG. 27 is a sectional view as taken along the lines 27—27 of FIG. 26.
Figure 29:
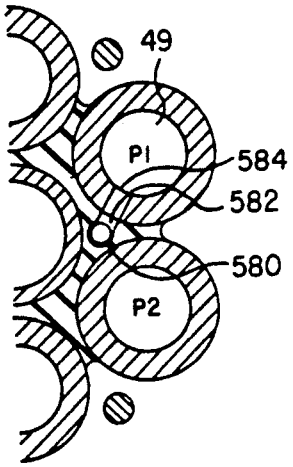
FIG. 29 is a sectional as taken along the lines 29—29 of FIG. 26 with the plunger valves removed.
Figure 30:
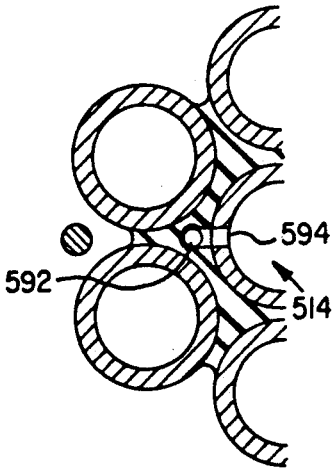
FIG. 30 is a sectional view taken along the lines 30—30 of FIG. 26 with plunger valves removed.

Referring additionally to FIGS. 27, 29 and 30, portion 118 of pilot fluid control means 116 receives pressurized pilot fluid through a passage comprised of a duct 574 communicating either with connection 576 or if plugged then via duct 578. The latter in turn communicates through a tube 580 and duct 582 with an opening 584 from P1 pressure opening 49. Alternatively, if opening 584 is plugged then communication is provided between connection 576, duct 574, and duct 578 before entering tube 580 and continuing through the valve to a pilot fluid connection 585 adjacent the end cap 558 (FIG. 25).

Fluid pressure received by the pilot fluid control is then supplied through passage 586 and if connection 588 thereat is plugged then through duct 590 communicating with tube 592. This tube in turn communicates with opening 594 into the piston cylinder assembly 514 between the piston 524 and seal 548 for biasing the piston upwardly in order to linearly displace pre-programmed plate 526.

Figure 35:
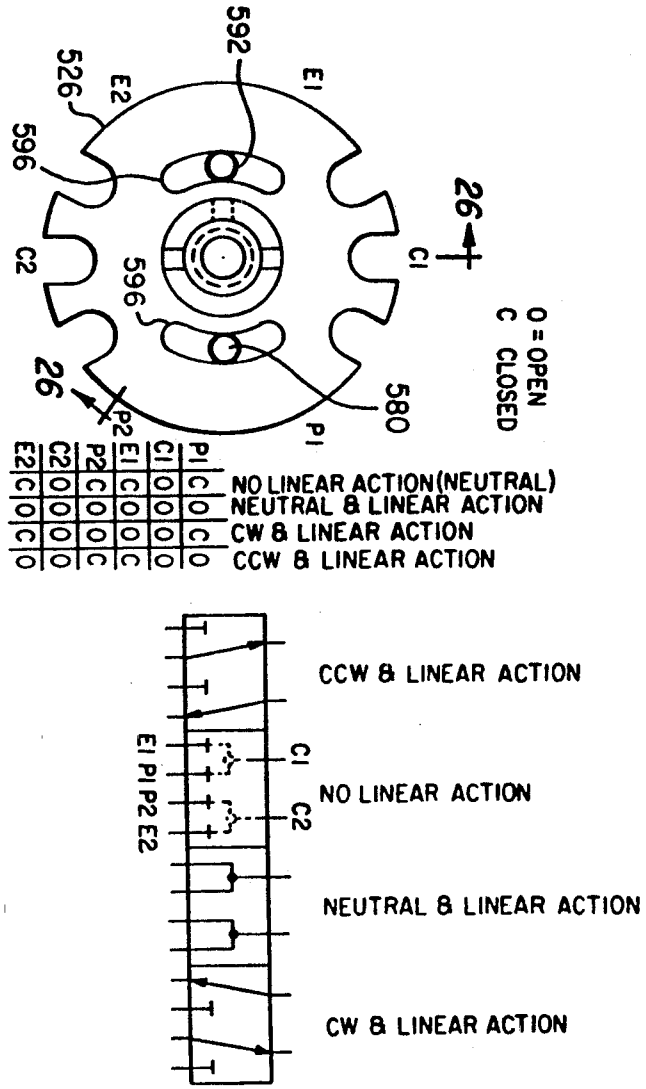
FIG. 35 is a plan view of a pre-programmed plate of the second embodiment for actuation of normally open and normally closed plunger valves providing for closed and open neutral flow conditions. A corresponding truth table and associated Symbol according to DIN ISO 1219 are also shown.

As best understood with reference to FIGS. 26 and 35, the pre-programmed plate 526 is both linearly and rotatably displaceable by means of the piston cylinder assembly 514. Limitation against linear displacement from the position shown solid in FIG. 26 to the position shown in phantom in FIG. 26 is imposed via removable flange 518 acting as a ceiling for piston 524. This permits the plate 526 to remain clear of the underside of member 560 for minimizing its frictional resistance when rotated. Tubes 580 and 592 within semicircular slots 596 serve to impose a limitation on arcuate displacement. When neither valve 500 and/or 512 are actuated linearly, a closed neutral condition exists as is indicated in FIG. 35 by the truth table showing either an open (O) or a closed (C) indication. When the plunger valves are actuated linearly by solid perimeter portions of the plate 526 bearing against the projections 528 of the valves, an open neutral condition occurs as is indicated in FIG. 26 and in FIG. 35 by the truth table showing an open (O) plunger valve 500 and/or 512 with linear action.

Figure 36:
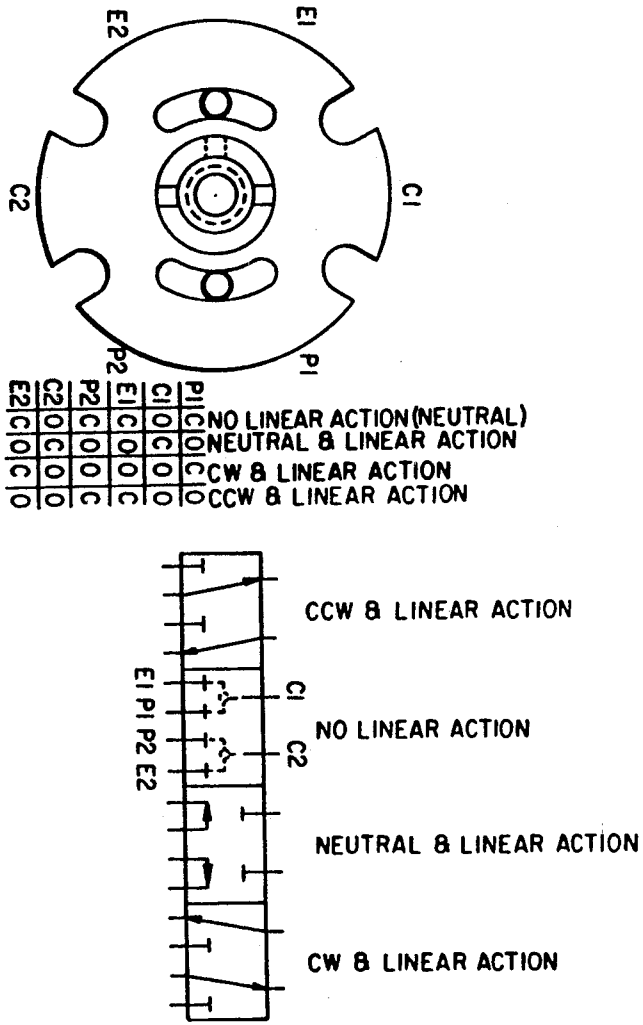
FIG. 36 is a plan view of a pre-programmed plate of the second embodiment for actuation of normally open and normally closed plunger valves providing for closed and tandem neutral flow conditions. A corresponding truth table and associated Symbol according to DIN ISO 1219 are also shown.
Figure 37:
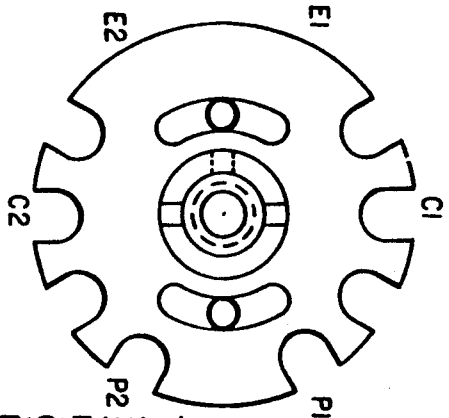
FIG. 37 is a plan view of a pre-programmed plate of the second embodiment for actuation of normally open and normally closed plunger valves providing for closed and float neutral flow conditions. A corresponding truth table and associated Symbol according to DIN ISO 1219 are also shown.
Figure 37:
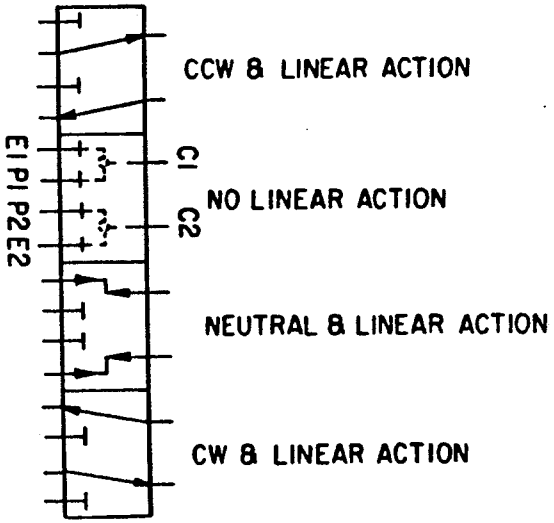
Figure 38:
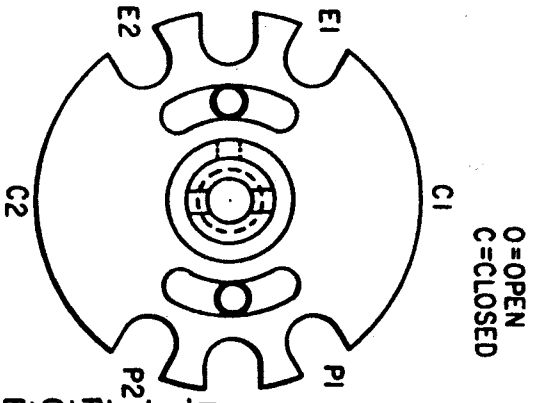
FIG. 38 is a plan view of a pre-programmed plate of the second embodiment for actuation of normally open and normally closed plunger valves providing for tandem and open neutral flow conditions. A corresponding truth table and associated Symbol according to DIN ISO 1219 are also shown.
Figure 38:
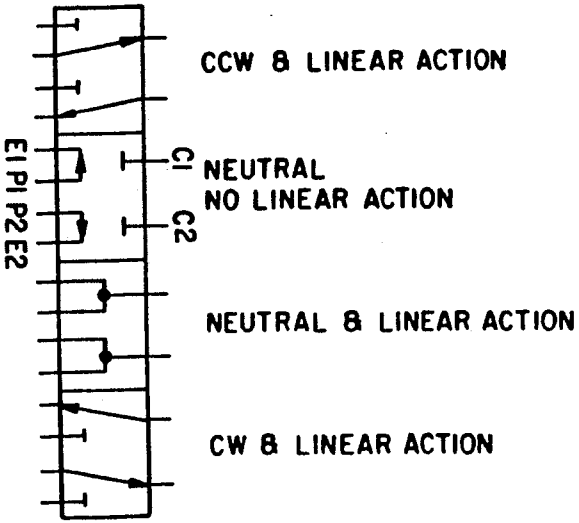
Figure 39:
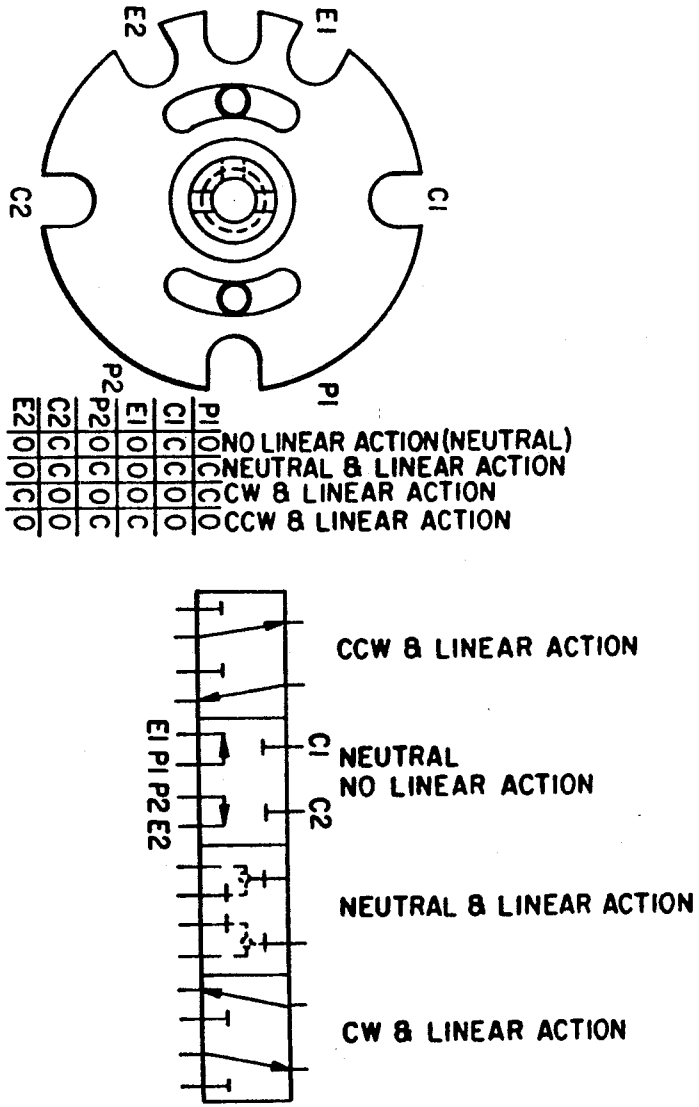
FIG. 39 is a plan view of a pre-programmed plate of the second embodiment for actuation of normally open and normally closed plunger valves providing tandem and closed neutral flow conditions. A corresponding truth table and associated Symbol according to DIN ISO 1219 are also shown.
Figure 40:
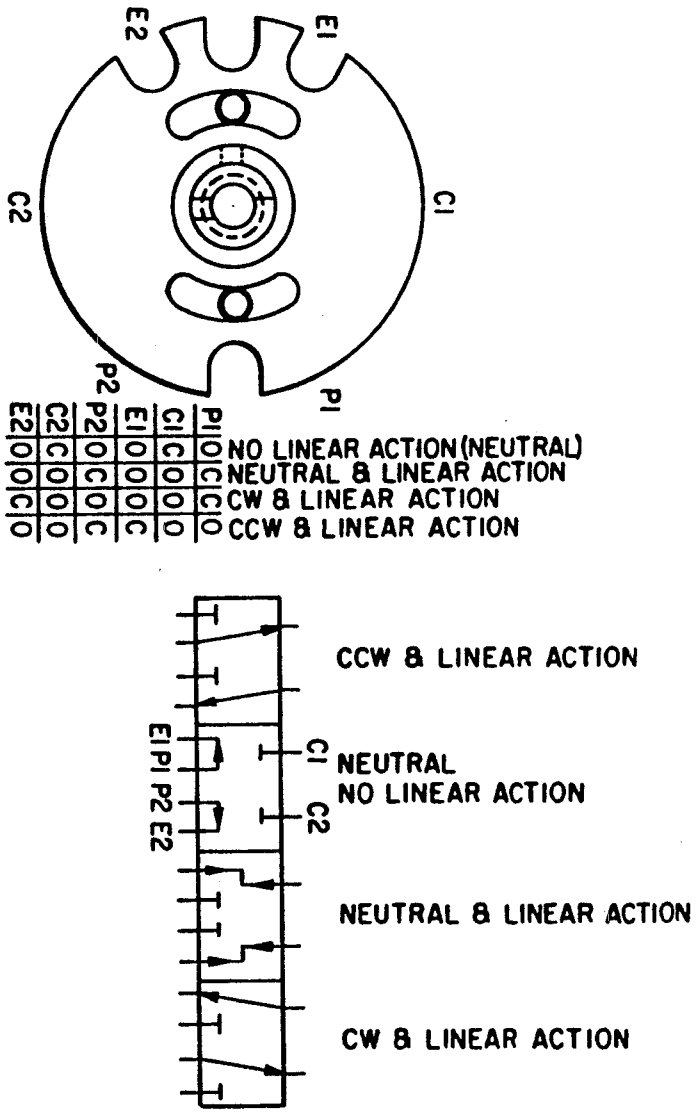
FIG. 40 is a plan view of a pre-programmed plate of the second embodiment for actuation of normally open and normally closed plunger valves providing for tandem and float neutral flow conditions. A corresponding truth table and associated Symbol according to DIN ISO 1219 are also shown.
Figure 41:
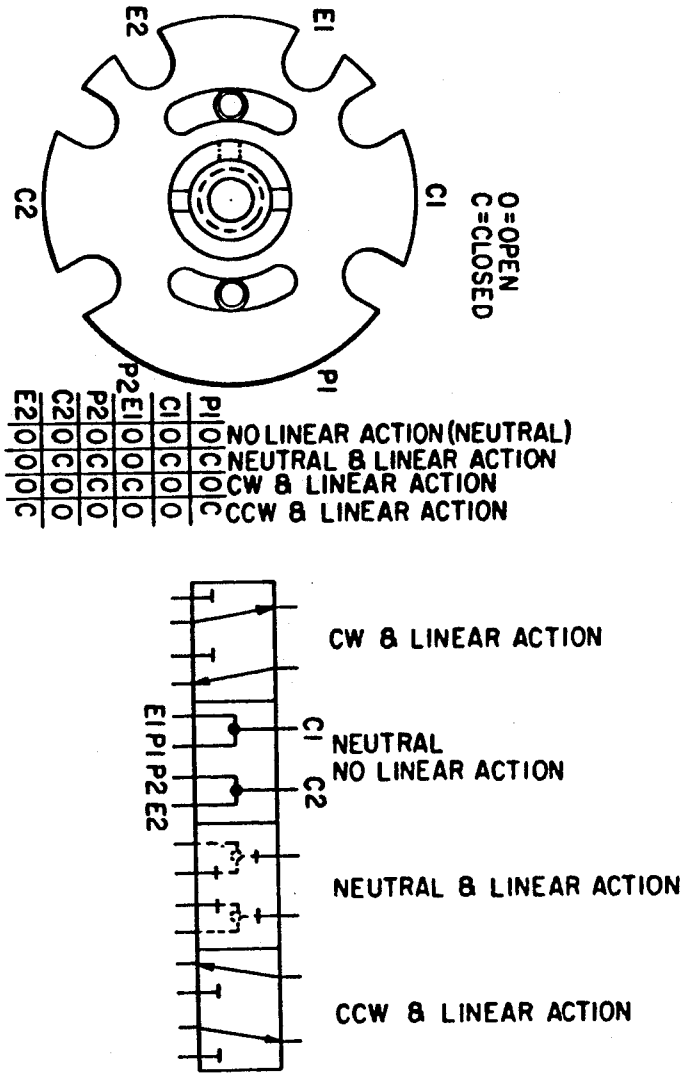
FIG. 41 is a plan view of a pre-programmed plate of the second embodiment for actuation of normally open plunger valves providing open and closed neutral flow conditions. A corresponding truth table and associated Symbol according to DIN ISO 1219 are also shown.
Figure 42:
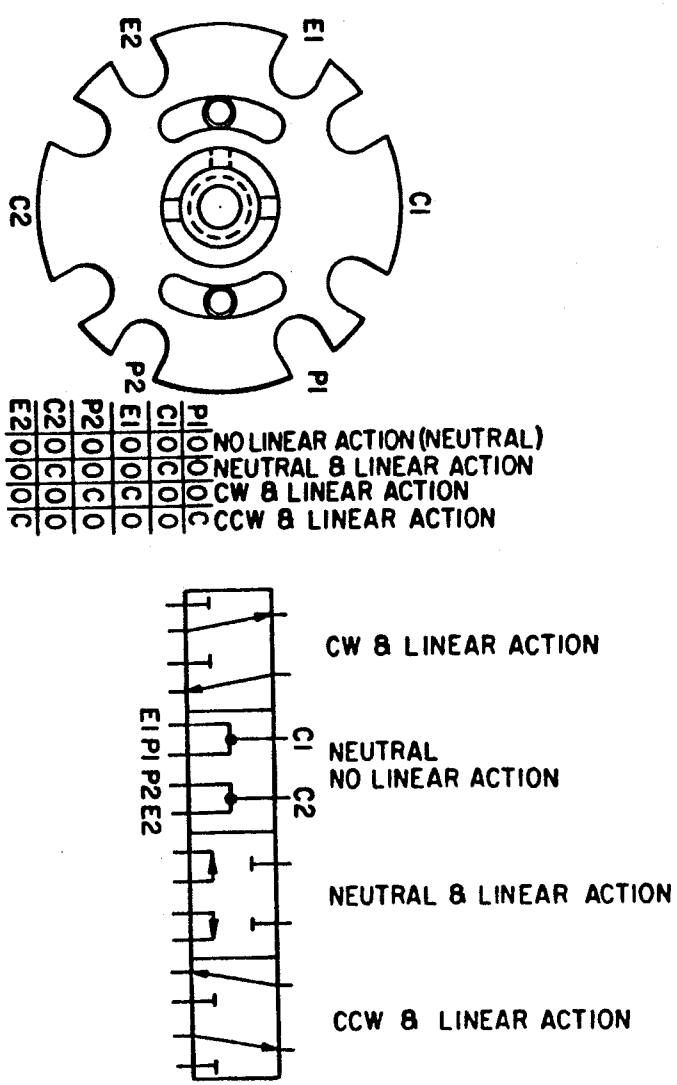
FIG. 42 is a plan view of a pre-programmed plate of the second embodiment for actuation of normally open plunger valves providing for open and tandem neutral flow conditions. A corresponding truth table and associated Symbol according to DIN ISO 1219 are also shown.
Figure 43:
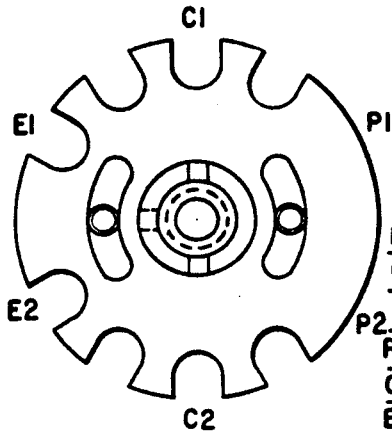
FIG. 43 is a plan view of a pre-programmed plate for actuation of normally open plunger valves providing for open and float neutral flow conditions. A corresponding truth table and associated symbol according to DIN ISO 1219 are also shown.
Figure 43:
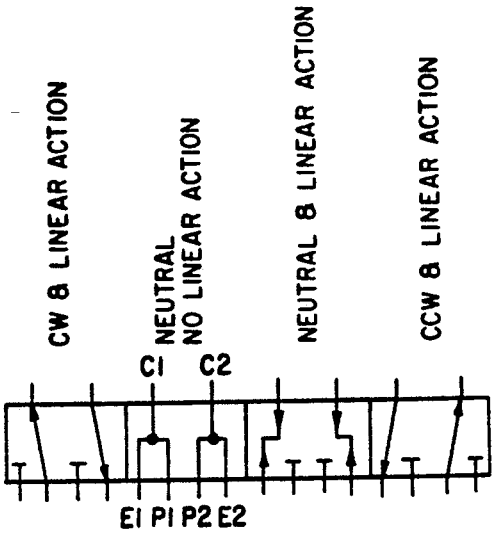

As indicated in FIG. 36, either a closed or a tandem neutral condition is produced with linear action, whereas in FIG. 37 either a closed or a float neutral condition is produced with linear action. Similarly, either a tandem or an open neutral condition is produced with linear action as shown in FIG. 38 whereas either a tandem or a closed neutral condition is produced with linear action as shown in FIG. 39. In FIG. 40, either a tandem or a float neutral condition is produced with linear action whereas in FIG. 41 either an open or a closed neutral condition is produced with linear action. In FIG. 42, linear action results in an open or a tandem neutral condition whereas in FIG. 43 it produces an open or a float neutral condition. Since the valve assembly comprises a separate pair of three cylinders each with interposed valves, each group may also be configured for different neutral conditions that might be required for control of single acting cylinders or rams operated in opposed directions and with different neutral condition requirements.

Figure 32:
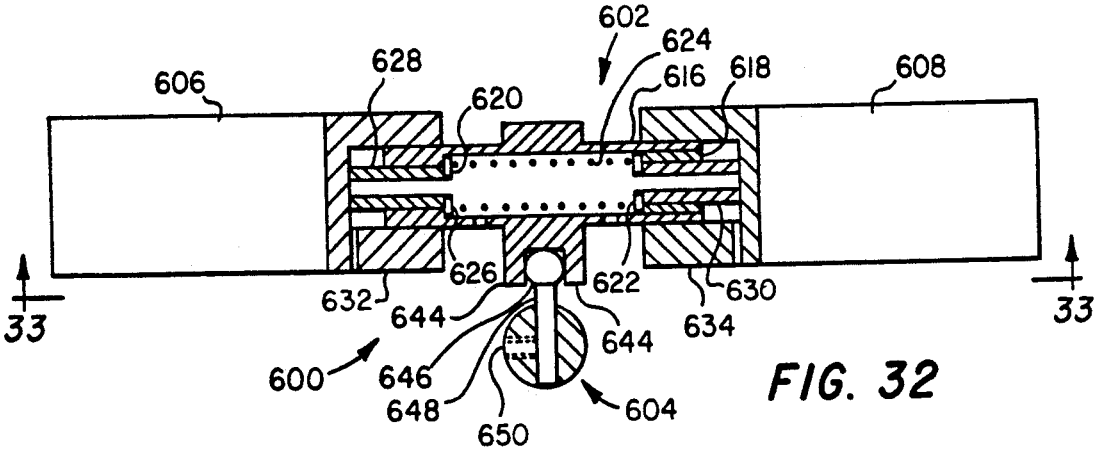
FIG. 32 is a sectional view taken along the lines 32—32 of FIG. 24.

The rotary actuator 600 hereof will now be described with particular reference to FIGS. 26, 32, 33, and 34. The actuator serves to selectively effect arcuate displacement of a selected pre-programmed plate and comprises a spring centering mechanism 602, a shaft 604 supported for rotation, and opposite pulling solenoids 606 and 608. Support for these items is provided by mounting 610 which in turn is secured to interposed member 560 through sleeve 612 surrounding tie bolts 614. As best seen in FIG. 32, the spring centering mechanism 602 comprises a tubular actuator 616 which at its right end contains an internal insert 618 in sliding contact with sleeve 630 while its left end of relatively greater cross-sectional thickness is in sliding contact with sleeve 628. Internally of the actuator compressed between the opposite washers 620 is a spring 624 for reasons as will be explained.

The outer end diameters of the actuator are slideably received internally of mounting blocks 632 and 634. In this arrangement, flanges 644 of the actuator normally remain at midpoint between the mounting blocks by the balance imposed force of the spring 624. Rotator shaft 604 is mounted between the flanges via a ball end 646, and an appendage 648 secured to the shaft by means of set screw 650. With centering mechanism 602 at the neutral location, shaft 604 is rotationally neutral but as the flanges are displaced, the shaft incurs a correlated arcuate displacement.

Restraining linear displacement of shaft 604 are retainer rings 654 and 656 positioned in shaft grooves 658 and 660 respectively. Rotatively coupling the shaft to pre-programmed plate 526 is a nylon bar 662 to which the shaft is secured via set screw 664. With the nylon bar being secured for rotation within slot 666, a command for arcuate displacement of the shaft results in a corresponding displacement of the plate 526. Since slot 666 is deeper than the width of bar 662, sliding communication is enabled during linear displacement of the plate.

Pulling solenoid 606 is secured to block 632 by means of hex nut 668 and pulling solenoid 608 is secured to block 634 by hex nut 669. The movable plungers 670 of solenoid 606 and 608 are secured to the actuator by pins 672 and 673 extending through a clevis 674 and a clevis mounting block 676. A pin 678 extending through the clevis mounting block secures the clevis to the actuator flanges 644.

Figure 33:
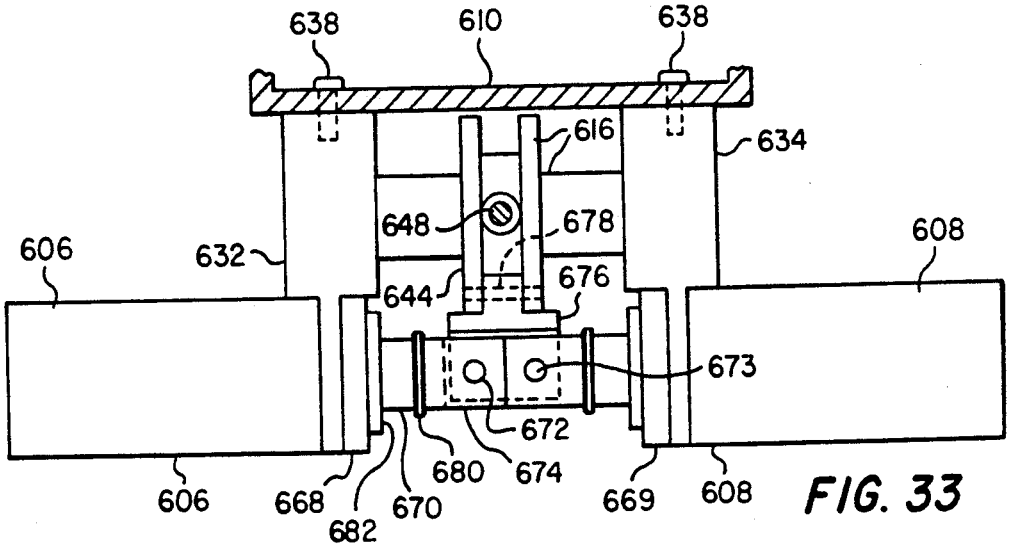
FIG. 33 is a front elevation view partially sectioned as seen from the position of 33—33 of FIG. 32.
Figure 34:
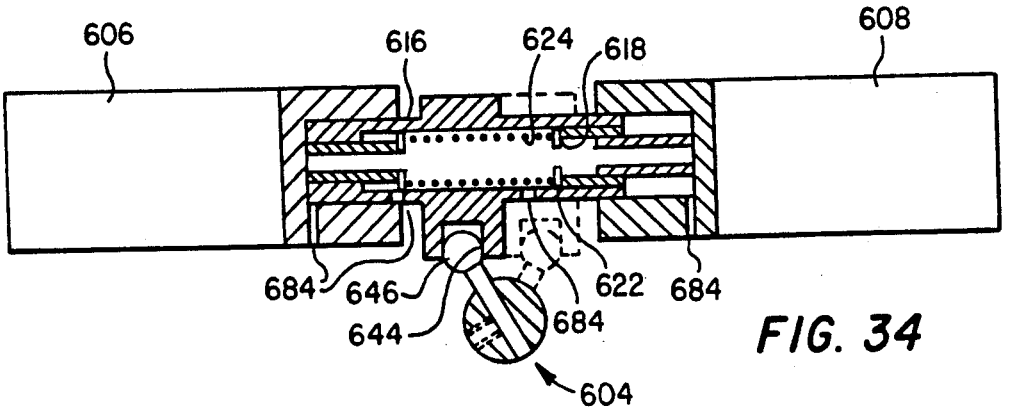
FIG. 34 is a sectional view similar to FIG. 32 but with the pulling solenoid in its actuated relation.

By comparatively observing FIGS. 32, 33, and 34, it can be seen that energizing the solenoid 606 causes its plunger 670 to be displaced leftwardly until the stop 680 makes contact with the solenoid end 682. This increases the compression of spring 624 while arcuately indexing shaft 604 counterclockwise via displacement of ball end 646 by flanges 644. This arrangement, as best seen in FIG. 34, will remain until solenoid 606 is deenergized at which time spring 624 will restore the components to their originally centered and neutral positions. Energizing of solenoid 608 causes opposite displacement of the actuator whereby all components will shift rightward as viewed in the drawings to effect clockwise displacement of shaft 604 and pre-programmed plate 526. Vent openings 684 relieve internal cavity pressures resulting from volume change during shifting of the actuator.

Figure 31:
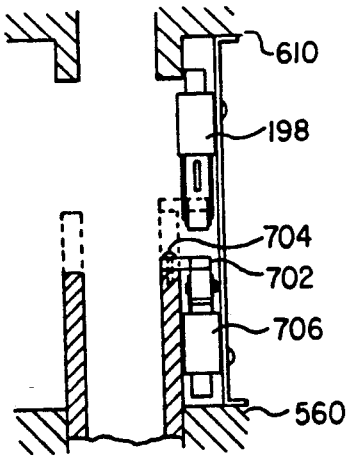
FIG. 31 is a sectional view taken along the lines 31—31 of FIG. 27 with components interior to the pre-programmed plate removed.

The rotary or arcuate position of plate 526 is sensed by infra-red (IR) senders 686 within actuating end 452, as best seen in FIGS. 23 and 26. The sender is secured through the appendage 688 and set screw 690 to rotating shaft 604 for arcuate displacement therewith. When the sender is positioned opposite IR receivers 692, 694, or 696 installed within printed circuit board 700, the affected IR receiver conducts electrical current indicating the rotary position of the plate. As seen in FIG. 31, microswitch 198 is contacted by extension 702 which in turn engages extension 556 of plate 526 via mounting screw 704 so as to indicate the linear position of the plate clear of the ends of valves 500 and 512. Second microswitch 706 is contacted in a like manner and indicates positioning of the plate 526 for effecting valve actuation. A switch and signal output conductor along with additional ROM programming added to the previously described FIGS. 15*a*, 15*b*, and 15*c* enable a user to select an alternate neutral condition corresponding to whether the plate 526 is linearly actuated or not.

Figure 44:
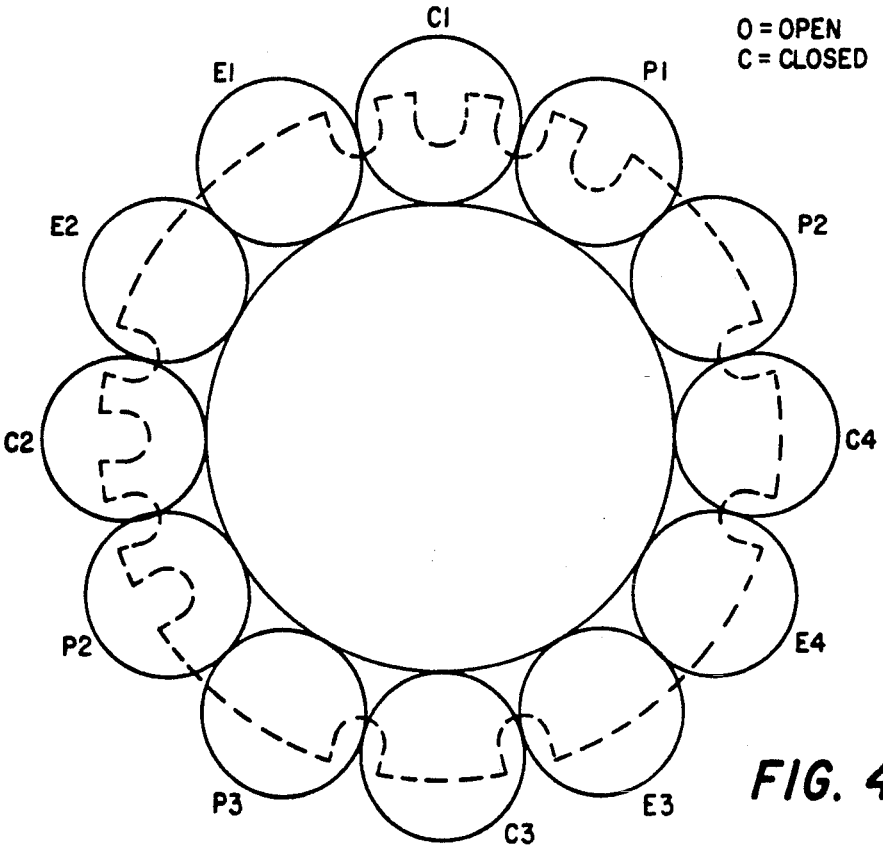
FIG. 44 is a schematic view of a pre-programmed plate for the actuation of two pairs of groups of three plunger valves in each group.
Figure 45:
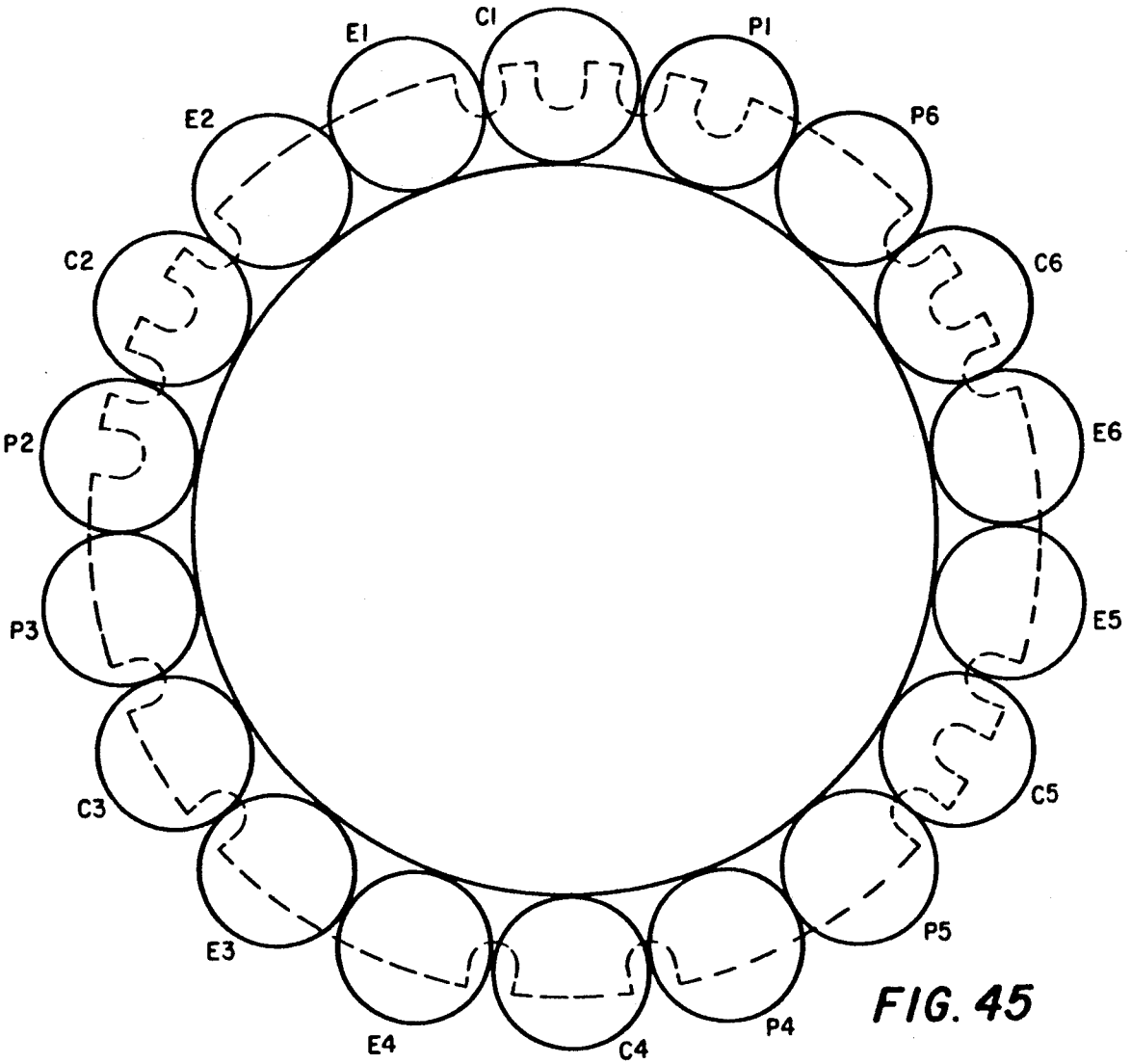
FIG. 45 is a schematic view of another pre-programmed plate for the actuation of three pairs of groups of three plunger valves in each group.

Alternative valve assemblies are exemplified by the schematic showings of FIGS. 44 and 45 for simultaneously controlling multiple working pistons and cylinders with selective neutral flow conditions. Observing the pre-programmed plates in their neutral position, it can be seen that the circular cutoffs or solid surfaces between pressure connections P1–P2 and between exhaust connections E1–E2 of different valve bore groups are shared when the pre-programmed plates 526 are rotated either clockwise or counterclockwise for contraction or extension of the working piston in the cylinder. In this manner, valves with any even number of valve bore groups arranged with adjacent pressure connections and adjacent exhaust connections will function with cut outs or solid surfaces placed over and between the valve cylinder groups. FIG. 44 incorporates the pre-programmed plate according to FIG. 37 in which plunger valve cylinder groups 1 (P1, C1, and E1) and 2 (P2, C2, and E2) as well as the pre-programmed plate of FIG. 36, groups 3 and 4. FIG. 45 incorporates six biased valve cylinder groups according to FIGS. 35, 36 and 37. With increased even numbers of valve-cylinder groups, a corresponding decrease will occur in the required clockwise and counterclockwise rotational angles necessary for valve operation and a corresponding decrease in valve operating time can be expected. With each increase by two in the number of valve-cylinder groups, the valve assembly length will remain essentially the same and its diameter will increase by approximately the diameter of two valve cylinders. For one inch diameter cylinders and two valve-cylinder groups, the valve assembly diameter is approximately three inches whereas for the same cylinder diameter deploying four valve-cylinder groups, the valve assembly diameter is approximately five inches, etc. Sharing of plates is limited to those plates having cut outs at the same corresponding locations.

Figure 46:
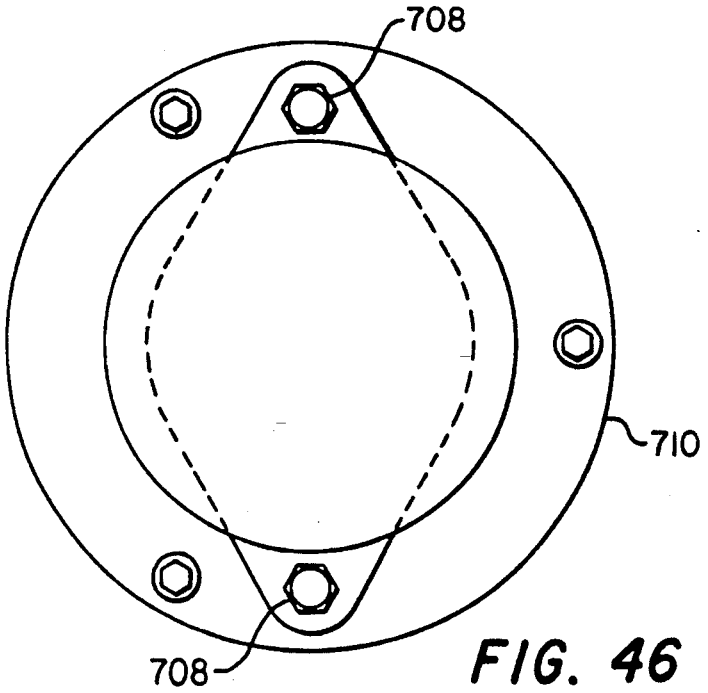
FIG. 46 is an end view of the valve assembly and actuator end utilizing a stepper motor for rotary actuation.
Figure 47:
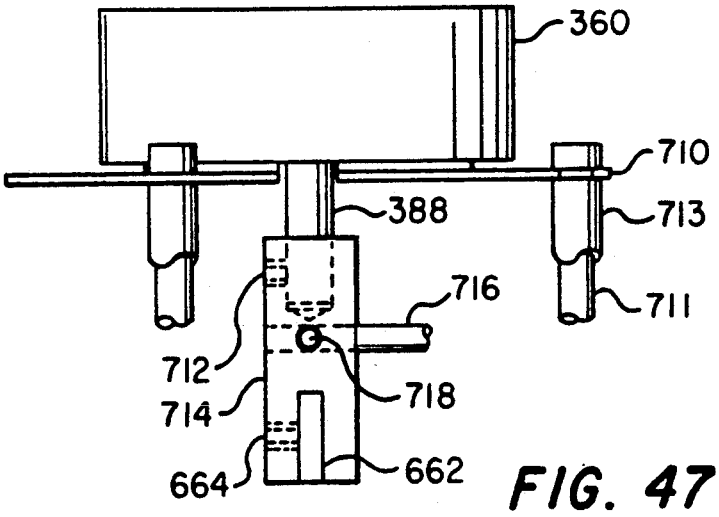
FIG. 47 is a fragmentary side view of the valve assembly utilizing a stepper motor for rotary actuation.

The stepper motor unit for this embodiment can be best understood with reference to FIGS. 26, 46 and 47 disclosing an alternative rotary actuator in the form of stepper motor 360. To accommodate this feature, the stepper motor is mounted on interposed member 560 by means of short bolts 708 securing the stepper motor to mounting plate 710. The mounting plate in turn is secured via tie bolts 713 and sleeves 711 directly to interposed member 560. Secured to the distal end of stepper motor shaft 388 is a coupling 714 secured thereto via set screw 712 whereas the opposite end of the coupling is adapted to receive nylon bar 662 in shaft 604 to be secured thereto via set screw 664.

Operation of the stepper motor in response to a user's command causes arcuate indexing of bar 662 and pre-programmed plate 526. As described supra, linear slot 666 being deeper than the width of the bar 662 permits extension 539 of the programmed plate to be in sliding linear relation with the bar and coupling when the preprogrammed plate is displaced linearly toward the bar. An appendage 716 secured in the coupling via set screw 718 supports the IR sender 686 for indicating rotary positions as described supra.

The described second embodiment hereof has many advantages in fabricating, servicing and operation of the equipment. By virtue of a two-piece construction of the normally closed valve unit 500, it can be more readily removed for seal replacement without having to disconnect the valve assembly from a customer's piping connection. The one-piece normally open valve 512 can similarly be removed and its use in combination with the normally closed valves allows more selective neutral conditions without actuation so as to afford enhanced efficiency in the operation of the valve assembly.

Because of the linear actuated piston, the need for fulcrums and rocker arms can be eliminated while minimizing frictional resistance as the pre-programmed plate is indexed to the various operational locations. The biased rotary actuator affords more selective instant closed, open or tandem neutral conditions on start up and greatly simplifies the valve control as all moveable components of the valves are set at their biased or neutral positions. The various embodiments of pre-programmed plates utilized in combination with the various normally open and normally closed valves provide at least a closed neutral condition without linear actuation in open, and tandem or float conditions with linear actuation. Alternatively, it can provide at least an open neutral condition without linear actuation and closed, tandem or float conditions with linear actuation with either contraction or extension of the working piston and cylinder. As a further alternative, it can provide at least a tandem neutral condition without linear actuation and open, closed or float conditions with linear actuation along with either contraction or extension of a working piston and cylinder. As a consequence, the number of individual valves requiring actuation for a given condition correspondingly decrease in actuation time.

Since many changes could be made in the above construction and many apparently widely different embodiments of this invention could be made without departing from the scope thereof, it is intended that all matter contained in the drawings and specification shall be interpreted as illustrative and not in a limiting sense.

What I claim is:

1. A valve assembly for selectively controlling pressurized fluid flow to operate a fluid operated working cylinder and piston comprising:

a) a valve body;

b) a pair of bore groups with each group defining at least three bores in said body;

c) biased plunger valves operably interposed in each of said bores;

d) a pair of separated flow passages on one side of said interposed valves, one of said passages being in continuously open flow communication commonly inter-connecting in parallel between the at least three bores of one bore group and the other of said passages being in continuously open flow communication commonly inter-connecting in parallel between the at least three bores of the other bore group;

e) pressure connection means leading to a first one of said bores in each bore group on the other side of said interposed valves;

f) first side cylinder connection means leading to a second one of said bores in one of each pair of bore groups;

g) second side cylinder connection means leading to a second one of the other one of each pair of bore groups;

h) exhaust connection means leading to a third one of said bores in each of said bore groups; and i) control means operably associated with said valves for selectably actuating said interposed valves in a predetermined sequence for effecting selected inter-connection between the flow passage thereat, said valves and corresponding cylinder connection means to provide either contraction, extension or a neutral condition for said working piston and cylinder.

2. A valve assembly as in claim 1 wherein said control means further comprises:

a selectable pre-programmed plate which is actuatable by said control means for providing any one of four operational neutral conditions selected from among closed, open, float or tandem conditions.

3. A valve assembly as in claim 2 wherein said valves are arranged in a circular pattern about an axis in said body and said control means further comprises:

a) a linear-to-rotary actuator mechanism connected to said selectable pre-programmed plate;

b) a linear actuator mechanism connected to said selectable pre-programmed plate;

c) pilot pressure control means including operator switches and position sensing switches operably associated with said rotary actuator and said linear actuator to selectably rotate and linearly actuate said pre-programmed plate; and d) circular cut out and solid surface pattern on said selectable actuator plate arranged in cooperation with said rotation and linear actuation to provide contraction, extension or neutral operation to said piston and cylinder.

4. A valve assembly as in claim 2 wherein said valves are arranged in a circular pattern about an axis in said body and said control means further comprises:

a) a rotary actuator mechanism connected to said selectable pre-programmed plate;

b) a linear actuator mechanism connected to said selectable pre-programmed plate;

c) control means including operator switches and position sensing switches operably associated with said rotary actuator and said linear actuator to selectably rotate and linearly actuate said pre-programmed plate; and d) circular cut out and solid surface pattern on said selectable pre-programmed plate arranged in cooperation with said rotation and linear actuation for opening and closing appropriate one of said valves to provide contraction extension or neutral operation to said piston and cylinder.

5. A valve assembly as in claim 4 wherein said rotary actuator mechanism comprises a stepper motor.

6. A valve assembly as in claim 4 wherein said rotary actuator mechanism comprises a rotary solenoid.

7. A valve assembly as in claim 4 wherein said linear actuator mechanism comprises a linear solenoid.

8. A valve assembly as in claim 1 in which at least some of said biased plunger valves are characterized as being normally open and others of said biased plunger valves are characterized as being normally closed.

9. A valve assembly for selectively controlling pressurized fluid flow to operate a fluid operated working cylinder and piston comprising:

a valve body;

two groups of three bores each in the valve body;

biased plunger valves operably interposed in each of the bores;

a pair of separated flow passages on one side of said interposed valves, one of said passages being in continuously open flow communication commonly inter-connecting in parallel between the three bores of one bore group and the other of said passages being in continuously open flow communication commonly inter-connecting in parallel between the three bores of the other bore group;

a first fluid connection inter-connected with the first one of the bores in each group for providing pressurized fluid to the first bore on the other side of the interposed valves;

a second fluid connection between the second bore in one of the bore groups and one side of a cylinder to be operated;

a third fluid connection between the second bore in the other bore group and a second side of the cylinder to be operated;

a fourth fluid connection in each bore group interconnected with the third one of the bores for exhausting fluid from the third bores on the other side of the interposed valves; and control means for selectably actuating the interposed valves in a predetermined sequence for inter-connection between the passage and selected of said fluid connections.

10. A valve assembly as recited in claim 9, wherein the control means further comprises a selectable pre-programmed plate mounted in the assembly for providing an operational neutral condition selected from among closed, open, float, and tandem conditions.

11. A valve assembly as recited in claim 10, wherein the valves are arranged in a circular pattern about an axis in the valve body.

12. A valve assembly as recited in claim 11, wherein the control means further comprises:

a rotary actuator mechanism connected to the selectable pre-programmed plate for rotating the plate;

a linear actuator mechanism connected to the selectable pre-programmed plate for moving the plate linearly; and a circular cut out and solid surface pattern on the selectable pre-programmed plate arranged in cooperation with the rotary actuator and the linear actuator for opening and closing selected one of the valves.

13. A valve assembly as recited in claim 12, wherein the rotary actuator is a stepper motor.

14. A valve assembly for selectively providing pressurized fluid to a first side of a two sided fluid operated piston within a cylinder and exhausting fluid from a second side of the piston, providing pressurized fluid to said second side of the piston and exhausting it from said first side and providing any one of four operational neutral conditions pre-selected from a closed condition, an open condition, a float condition, and a tandem condition; said valve assembly comprising:

a) a body having first and second ends and a central axis extending therebetween;

b) even groups of three bores each defined by said body substantially parallel to said central axis, each bore being substantially equidistance radially outward from said central axis and substantially equidistance from each other bore radially about said central axis;

c) passage means in said body inter-connecting each group of three bores;

d) pressure source connection means in said body for connecting a first one of each group of three bores to a source of fluid pressure;

e) cylinder connection means in said body for connecting a second one of said each group of three bores to a corresponding side of said piston in said cylinder;

f) exhaust connection means in said body for connecting each group of three bores to an exhaust fluid reservoir;

g) a valve interposed in each of said bores biased in a closed position and openable against said bias to inter-connect said connection means with said passage means;

h) valve actuation means rotationally positionable in radial increments corresponding to the distance between each bore about said central axis and linearly moveable along said central axis having solid surfaces for contacting said valves to overcome said closed bias and to inter-connect said pressure cylinder or exhaust connections with said passage when said actuation means is moved linearly and interposed voids in said solid surface for not contacting said valves when said actuation means is moved linearly; and i) means for selecting a neutral rotational position and neutral linear movement to select an operational neutral condition from among a closed, an open, a float or a tandem condition.

15. A valve assembly for selectively controlling pressurized fluid flow to operate at least one fluid operative working cylinder and piston comprising:

a) a valve body;

b) at least one pair of bore groups with each group defining at least three bores in said body;

c) a biased plunger valve operably interposed in each of said bores;

d) a pair of separated flow passages defined on one side of said interposed valves, one of said passages commonly inter-connecting the three bores of one bore group and the other of said passages commonly inter-connecting between the three bores of the other bore group; each of said passages being in continuous open flow communication and providing a parallel flow relation with respect to the bores to which they are inter-connected respectively;

e) a first of said bores of each group being adapted to receive pressurized fluid to be supplied to a working cylinder and piston;

f) a second of the bores of each group being adapted to exhaust pressurized fluid returned from the working cylinder and piston;

g) a third of the bores of each group being adapted to conduct pressurized fluid between the working cylinder and piston and a selected of said first and second bores; and h) control means operable for selectively actuating said valves in a predetermined sequence for effecting selected flow interconnection between said first, second and third bores and the flow passage thereat.

16. A valve assembly as recited in claim 15 in which said control means is operative to selectively provide contraction, extension or a choice of neutral conditions for a working piston and cylinder with which said valve assembly is utilized.

17. A valve assembly in accordance with claim 15 in which all of said plunger valves are biased toward an open condition to fluid flow.

18. A valve assembly as recited in claim 15 in which some of said plunger valves are biased toward a closed condition to fluid flow and others of said plunger valves are biased toward an open condition to fluid flow for their arrangement to enable establishing an operationally neutral condition of the valve assembly without actuating said plunger valves selected from among at least closed, open and tandem conditions.

19. A valve assembly as recited in claim 15 in which said control means further comprises a selective pre-programmed plate mounted in the assembly for providing operational neutral conditions selected from among at least closed and open, closed and tandem, closed and float, tandem and open, tandem and closed, tandem and float, open and closed, open and tandem and open and float conditions.

20. A valve assembly as recited in claim 19 wherein said control means further comprises:

a rotary actuator mechanism connected to the selected pre-programmed plate for arcuately indexing the plate;

a linear actuator mechanism connected to the plate for displacing the plate linearly to a location at which relatively reduced frictional resistance to arcuate indexing by said rotary actuator mechanism is to be encountered; and a circular cut out and solid surface pattern on the selected pre-programmed plate arranged in cooperation with the rotary actuator and the linear actuator for opening and closing selected ones of the interposed valves.

21. A valve assembly as recited in claim 20 wherein said rotary actuator mechanism comprises:

a) an elongated actuator supported for slidable linear displacement bidirectionally from a neutral position;

b) a first solenoid attached to said actuator for effecting slidable linear displacement of said actuator in a first direction from said neutral position;

c) a second solenoid attached to said actuator for effecting linear slidable displacement of said actuator in the opposite direction from said neutral position; and d) a shaft operably connected between said actuator and said plate and responsive to said bidirectional displacement of said actuator to effect arcuate indexing of said plate.

22. A valve assembly as recited in claim 21, in which said actuator is spring biased toward said neutral position.

* * * * *